US009704459B1

(12) United States Patent
Paterson

(10) Patent No.: US 9,704,459 B1
(45) Date of Patent: Jul. 11, 2017

(54) PICK HOLDER

(71) Applicant: Robert Bruce Paterson, Tenafly, NJ (US)

(72) Inventor: Robert Bruce Paterson, Tenafly, NJ (US)

( * ) Notice: Subject to any disclaimer, the term of this patent is extended or adjusted under 35 U.S.C. 154(b) by 84 days.

(21) Appl. No.: 14/971,423

(22) Filed: Dec. 16, 2015

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS

| | | | | |
|---|---|---|---|---|
| 4,467,693 | A * | 8/1984 | Nasfell, Jr. | G10D 3/163 84/322 |
| 4,785,708 | A | 11/1988 | Vaughan | |
| 5,127,300 | A * | 7/1992 | Silverman | G10D 3/163 84/329 |
| 5,231,238 | A | 7/1993 | Adams | |
| 5,299,485 | A | 4/1994 | Denton | |
| 5,495,644 | A | 3/1996 | Mesher | |
| 5,796,021 | A | 8/1998 | Longshore | |
| 6,140,564 | A | 10/2000 | Pia | |
| 6,215,052 | B1 * | 4/2001 | Giddens | G10D 3/163 211/120 |
| 6,639,136 | B1 * | 10/2003 | Judd | G10D 3/163 84/320 |
| 6,933,430 | B2 | 8/2005 | Oskorep | |
| 7,417,184 | B2 | 8/2008 | Weathersby | |
| 7,626,103 | B1 | 12/2009 | Phillips | |
| 8,097,799 | B2 * | 1/2012 | Tran | G10D 3/163 84/322 |
| 8,134,059 | B2 * | 3/2012 | Zink | G10D 3/163 84/320 |
| D717,368 | S | 11/2014 | Rivers | |
| 9,018,502 | B2 | 4/2015 | Aletto | |
| 9,530,394 | B1 * | 12/2016 | Corcorran | G10D 3/163 |
| 2015/0223575 | A1 * | 8/2015 | Farnum | G10D 3/163 63/1.11 |
| 2015/0255050 | A1 * | 9/2015 | Diaz Lopez | G10D 3/163 84/322 |

* cited by examiner

*Primary Examiner* — Robert W Horn
(74) *Attorney, Agent, or Firm* — Garcia-Zamor IP Law; Ruy M. Garcia-Zamor

(57) ABSTRACT

A musical instrument accessory for optimizing the comfort and ease with which musicians can play instruments. The accessory can be manufactured as a high end accessory made with gems and/or can be customized to provide a unique aesthetic appearance. In a preferred embodiment, the accessory allows for multiple picks to be detachably stored which may have different sizes and shapes.

20 Claims, 17 Drawing Sheets

PICK HOLDER

BACKGROUND

The present invention is generally directed to musical instrument accessories and, more specifically, accessories configured to hold multiple picks for musical instruments, such as guitars and banjos, in a portable carrier that allow easy access to these picks.

Many existing pick holders suffer from one or more of several existing deficiencies. Existing holders tend to save space by requiring picks to be stacked and spring loaded, which is space efficient but can be difficult to load and keep players from being able to reach multiple picks or store picks of multiple sizes. Other pick holders allow for picks of multiple sizes to be stored, but do so merely providing multiple spring-loaded chambers, increasing size and making the holder large and unwieldy. And still other pick holders offer multiple picks in individual pockets, thus allowing for storage of picks of varying size, yet by keeping these picks from overlapping or from being held in varying orientations, these holders again become too large to be easily transported and used.

It may be advantageous to provide a pick holder that may: be configured for holding picks in multiple planar levels; store picks in multiple orientations; allow space to be optimized allowing the pick holder to be smaller and more ornate; hold picks without the use of dividers or springs, allowing picks of multiple sizes to be held and for picks to be removed without moving any other picks held within the pick holder; be wearable on a strap or clothing; be more aesthetically pleasing than existing pick holders; be efficient to manufacture; and/or be durable under extended use.

SUMMARY

Briefly speaking, one embodiment of the present invention is directed to a pick holder which may include two sidewalls generally parallel to one another. These sidewalls may create a gap wherein one or more picks can be held in varying orientations such that each can follow a different path when being inserted into the holder. In other words, picks can preferably, but not necessarily, be inserted from at least three lateral sides of the holder, rather than a single direction. The pick holder may allow picks to be independently removed without causing any other pick to move or be detached from the holder.

In a separate aspect, the present invention is directed to a pick holder which may include two sidewalls generally parallel to one another. These sidewalls may create a gap wherein one or more picks can be held, allowing them preferably to be independently removed without causing any other pick to move or be detached from the holder. The pick holder may include a face plate disposed on the outer facing surface of one of the sidewalls which may form a second gap for one or more picks to be held, parallel to the picks in the first gap. This second gap may allow picks in the second gap to overlap with picks held in the first gap while allowing allows picks in the second gap to be independently removed without causing any other pick to move or be detached from the holder.

In a separate aspect, the present invention is directed to a pick holder which may include two sidewalls generally parallel to one another which may create a gap wherein one or more picks can be in varying orientations, such that each can follow a different path when being inserted into the holder. The pick holder may further include a face plate disposed on the outer facing surface of one of the sidewalls which may form a second gap for one or more picks to be held, parallel to the picks in the first gap. This second gap may allow picks in the second gap to overlap with picks held in the first gap, while allowing allows picks in the second gap to be independently removed without causing any pick in the first gap to move or be detached from the holder. The pick holder may allow picks to be stored in different orientations and to overlap while being stored in such a manner than any pick can be removed from the pick holder without causing any other pick to move or be detached from the holder.

In another aspect, the present invention is directed to a pick holder which may have a face plate that is capable of attaching additional picks thereto.

In another aspect, the present invention is directed to a pick holder that may be used simultaneously with picks of different sizes and shapes.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENT

Figure 1:
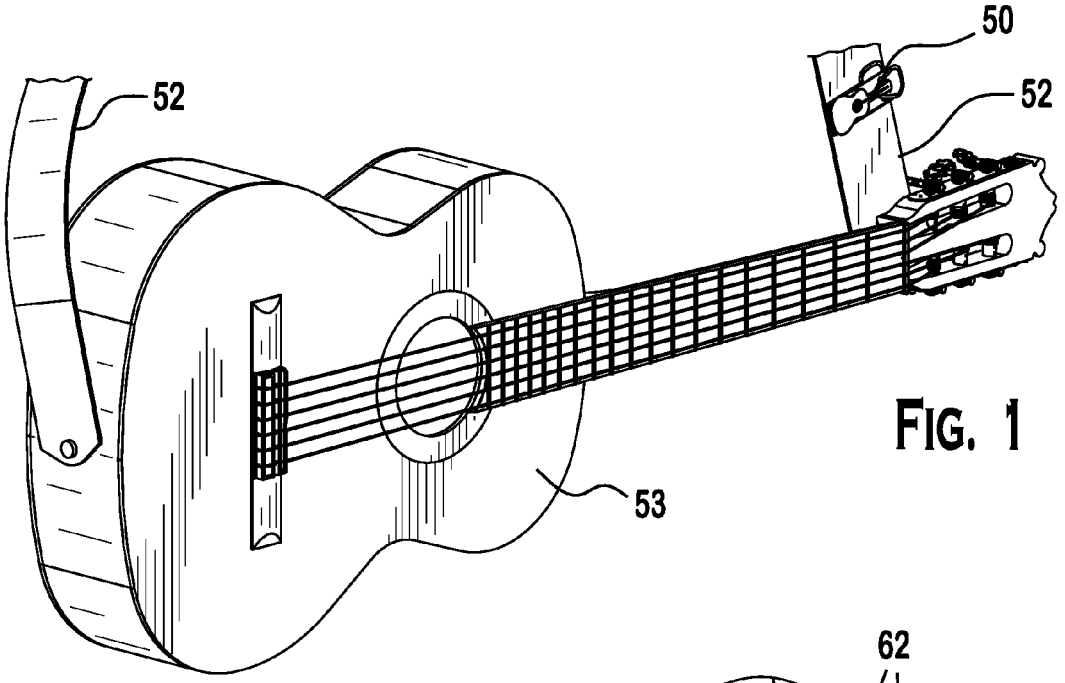
FIG. 1 is a perspective view of a first preferred embodiment of the pick holder 50 affixed to a guitar strap 52 which is itself affixed to a guitar 53. The view demonstrates how the pick holder 50 may be used, and demonstrates how the pick holder 50 would be convenient for a player of the guitar 53. One of ordinary skill in the art would appreciate from this disclosure that the pick holder 50 can be worn without departing from the scope of the present invention.

Certain terminology is used in the following description for convenience only and is not limiting. The words "right," "left," "top," and "bottom" designate directions in the drawings to which reference is made. The words "outer" and "inner" refer to directions away from and toward, respectively, the geometric center of the pick holder. The term "generally parallel" designates surfaces positioned within fifteen degrees (15°) of true mathematic parallel, which is to say that in reference to an imaginary stable line bisecting the surfaces, the surface extend away in an angle within fifteen degrees (15°) of the angle of the other surface. Additionally, the words "a" and "one" are defined as including one or more of the referenced item unless specifically stated otherwise. The terminology includes the words above specifically mentioned, derivatives thereof, and words of similar import.

Figure 2:
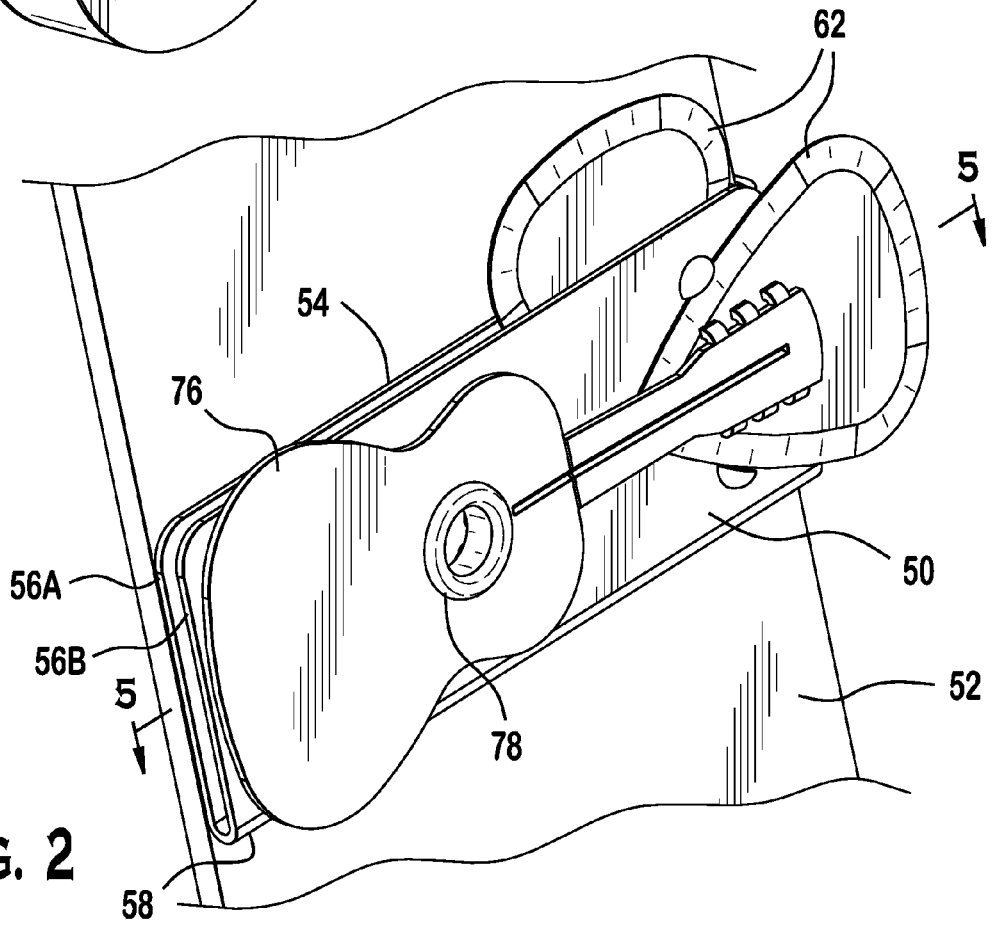
FIG. 2 is an enlarged perspective view of the pick holder 50 of FIG. 1 illustrating the pick holder 50 affixed to a guitar strap 52, which better demonstrates the features of the preferred embodiment of the pick holder 50. The preferred embodiment depicted includes picks 62 being held detachably within the first gap 60 formed between the sidewalls 56 of the holder body 54 and the second gap 80 formed between the face plate 76 and the holder body 54.

Referring to FIGS. 1-43 wherein like numeral indicate like elements throughout, there are shown preferred embodiments of a pick holder 50. The pick holder 50 is preferably, but not necessarily, configured to hold multiple picks 62 such that any one pick 62 can be removed, preferably without moving or causing to be removed from the holder any other pick 62. Referring to FIGS. 1 and 2, the pick holder 50 is preferably configured to be detachably positioned on a guitar strap 52 attached to a guitar 53 such that the pick holder 50 can be used by the player of the guitar 53 while playing. However, those of ordinary skill in the art will appreciate from this disclosure that the pick holder 50 need not be affixed to a guitar strap 52, but rather could be affixed to any other surface, such as a belt, waste band, pocket, or no surface at all, without departing from the scope of the present invention.

The pick holder 50, and its component parts, are preferably formed of a suitably durable, strong material, such as an alloy. However, those of ordinary skill in the art will appreciate from this disclosure that any suitable material can be used without departing from the scope of the present invention. For example, the pick holder 50 may be formed of a suitable polymer or metal without departing from the scope of the present invention. The pick holder can be formed using CNC equipment, injection molding, or using any other suitable manufacturing process without departing from the scope of the present invention.

Figure 3:
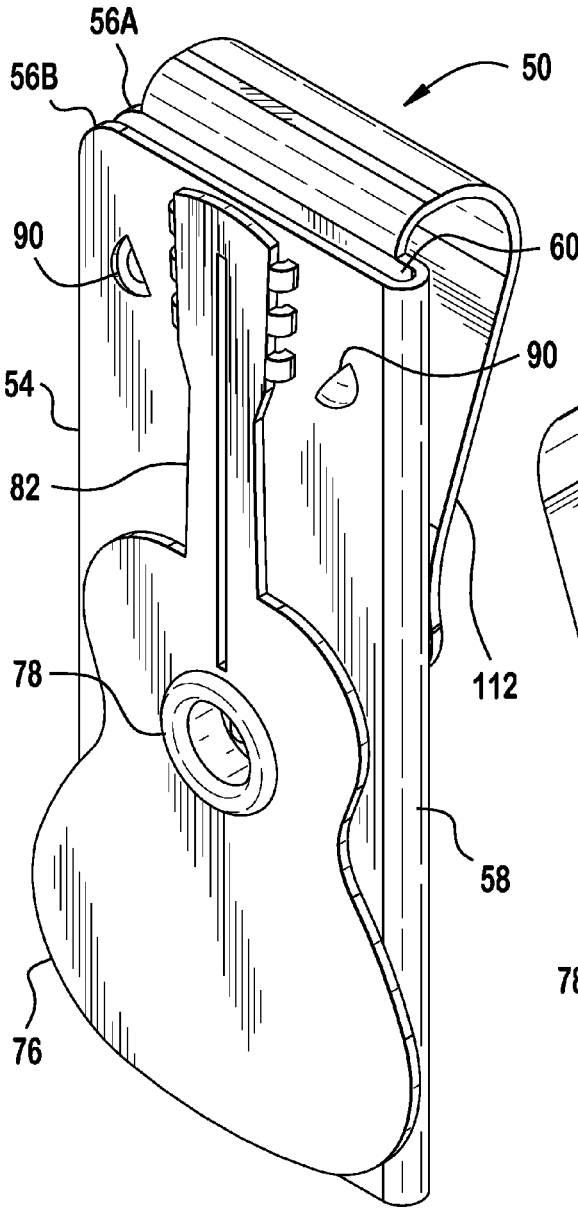
FIG. 3 is a front perspective view of the pick holder 50 of FIG. 1 which demonstrates the preferred embodiment of the pick holder 50 including a holder body 54 including two sidewalls 56 which form a first gap 60 and may be conjoined by a lateral wall which may span an entire side of the sidewalls 56. A clip member 112 may be affixed to this holder body 54. In this preferred embodiment, a second gap 80 is formed between the holder body 54 and a face plate 76 which is affixed to the holder body 54 via a fastener 78. The face plate 76 may include an elongated portion 82 which extends upwards such that it covers only an edge 88 of a pick 62 present in the second gap 80. The elongated portion 82 may further include second linear deformations 84 and or prongs 88 which extend into the second gap 80 to bias a pick 62 to remain therein. The holder body 50 may further include abutments 90 affixed to the outer surface of the second sidewall 56B and extending into the second gap 80 such that they abut the pick 62 and prevent more than half of the pick 62 from being covered by the elongated portion 82 of the face plate 76.
Figure 4:
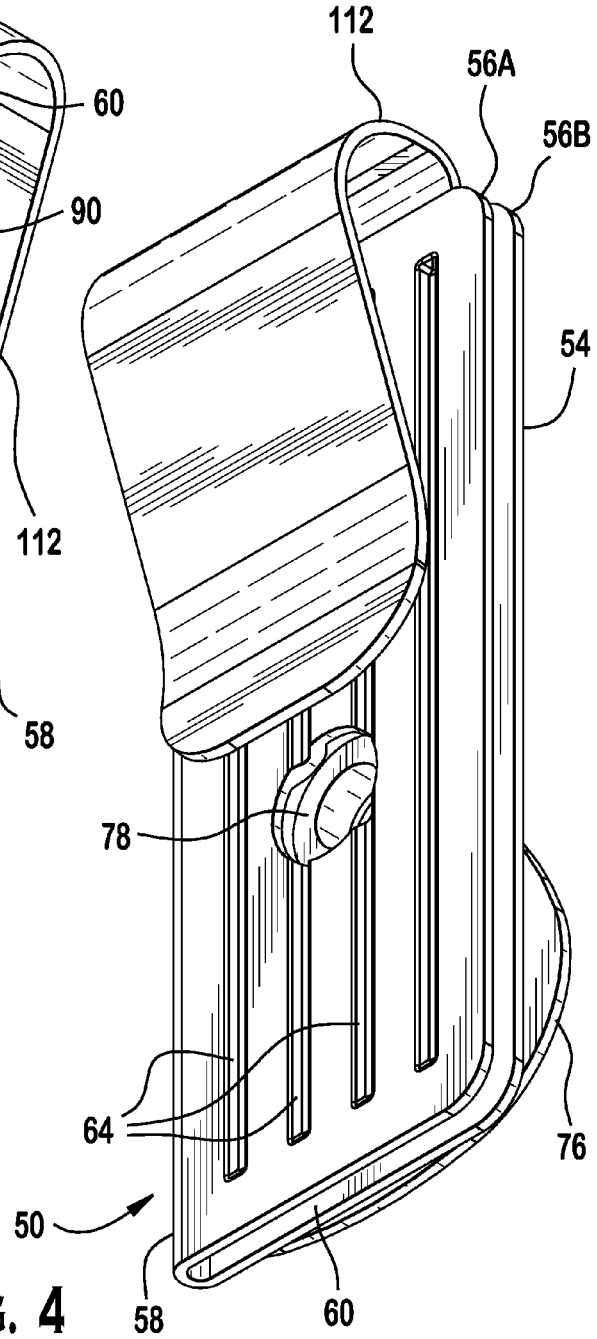
FIG. 4 is a rear perspective view of the pick holder 50 of FIG. 3 which demonstrates the preferred embodiment of the pick holder 50 including a holder body 54 with a first sidewall 54A and a second sidewall 54B. In this preferred embodiment, the first sidewall 54A may include first linear deformations 64 which may protrude into the first gap 60 to facilitate securing picks 62 which have been inserted into the first gap 60 to remain therein.
Figures 9, 10:
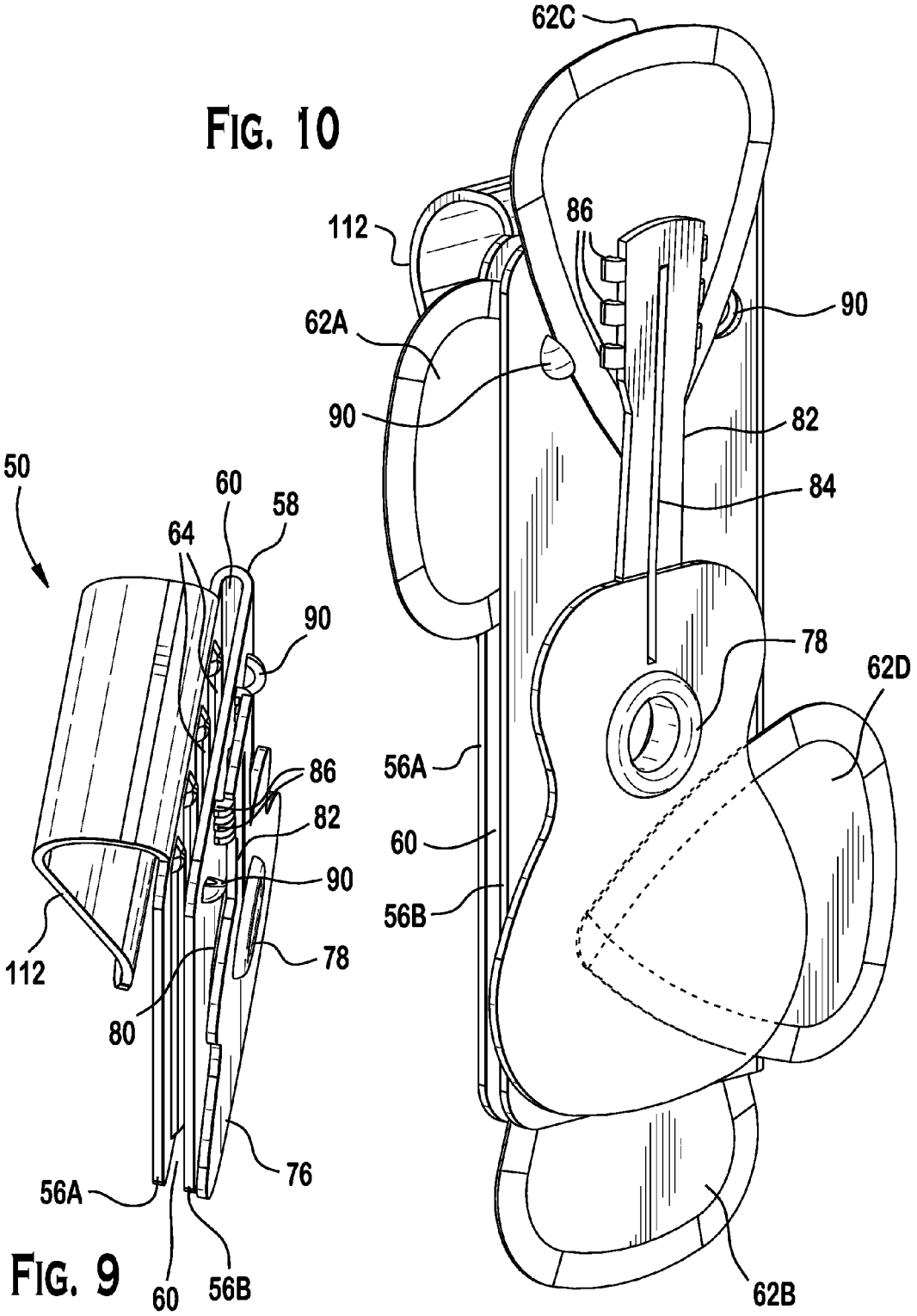
FIG. 9 is a top perspective view of the pick holder 50 of FIG. 3 which demonstrates the preferred embodiment of the pick holder 50 including a holder body 54 with sidewalls 54 and a lateral wall 58 which form a first gap 60, first linear deformations 64 in the first sidewall 56A which extend into the first gap 60; a clip member 112 affixed to the holder body 54; and a face plate 76 affixed to the second sidewall 54B by a fastener 78 forming a second gap 80 between the face plate 76 and the second sidewall 54B for picks 62 to be stored therein, the face plate 76 further including an elongated portion 82 with second linear deformations 84 and prongs 86 to hold a pick 62 within the second gap 80 in conjunction with abutments 90 affixed to the second sidewall 54B.
FIG. 10 is front perspective view of the pick holder 50 of FIG. 9 demonstrating that picks 62 may held within the pick holder 50 on varying planar levels and in varying orientations. Picks 62A and 62B are held within the first gap 60 on the same planar level, but with pick 62A in a right-facing orientation and pick 62B in an upward-facing orientation. Picks 62C and 62D are on a second planar level, being held in the second gap 80, but are in different orientations, with pick 62C in a downward-facing orientation and pick 62D in a left-facing orientation. Each of the picks 62 can be placed into the pick holder 50 through different insertion paths, and any one of the picks 62 may be removed without dislodging or causing any other pick to move.
Figure 11:
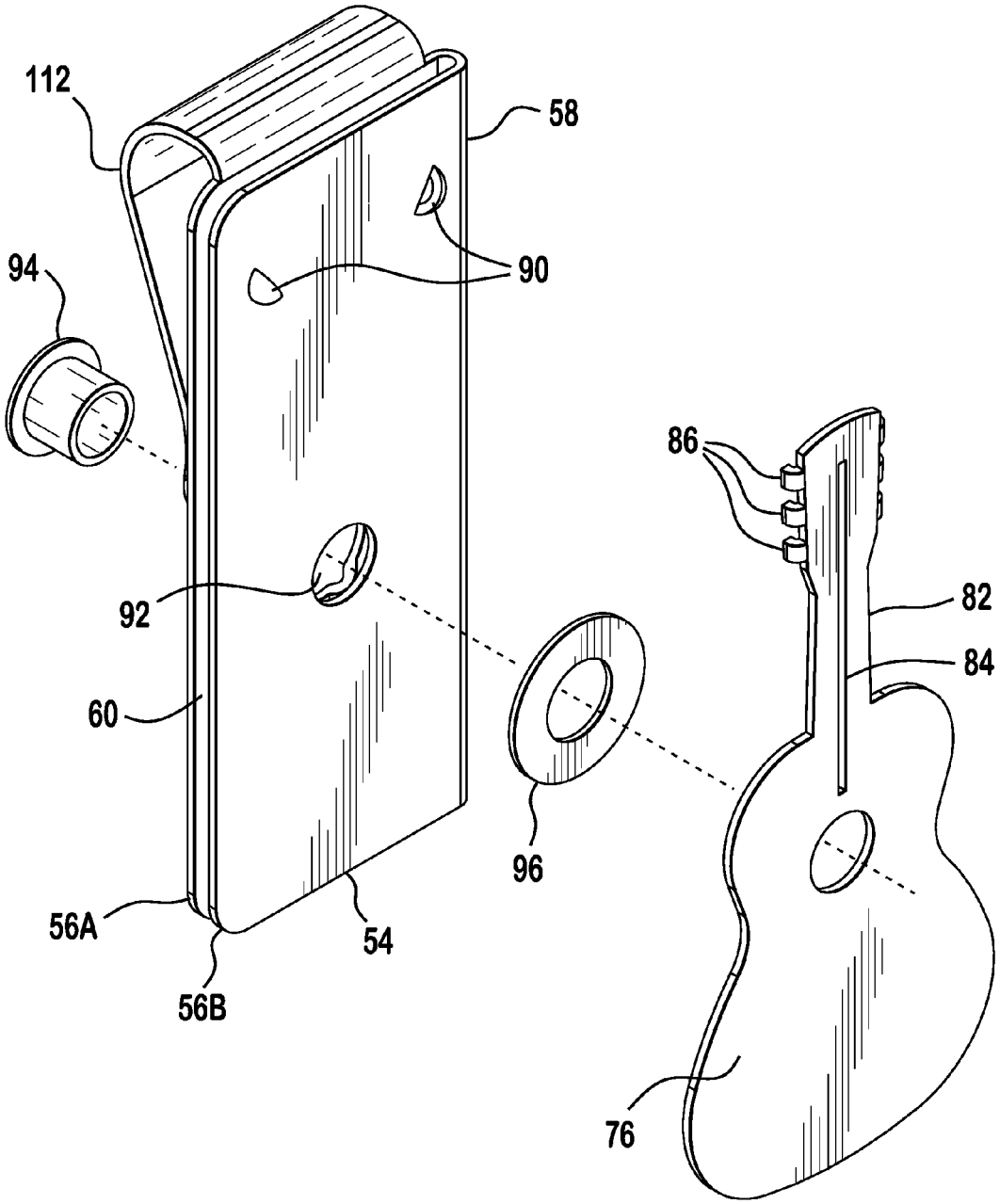
FIG. 11 is an exploded front perspective view of the pick holder 50 of FIG. 10 demonstrating that in the preferred embodiment, the face plate 76 is affixed to the holder body 54 by a fastener 78 which is inserted through a single bore 92 through the face plate 76, holder body 54, and a flat washer 96, with the flat washer 96 providing space to form the second gap 80.
Figure 12:
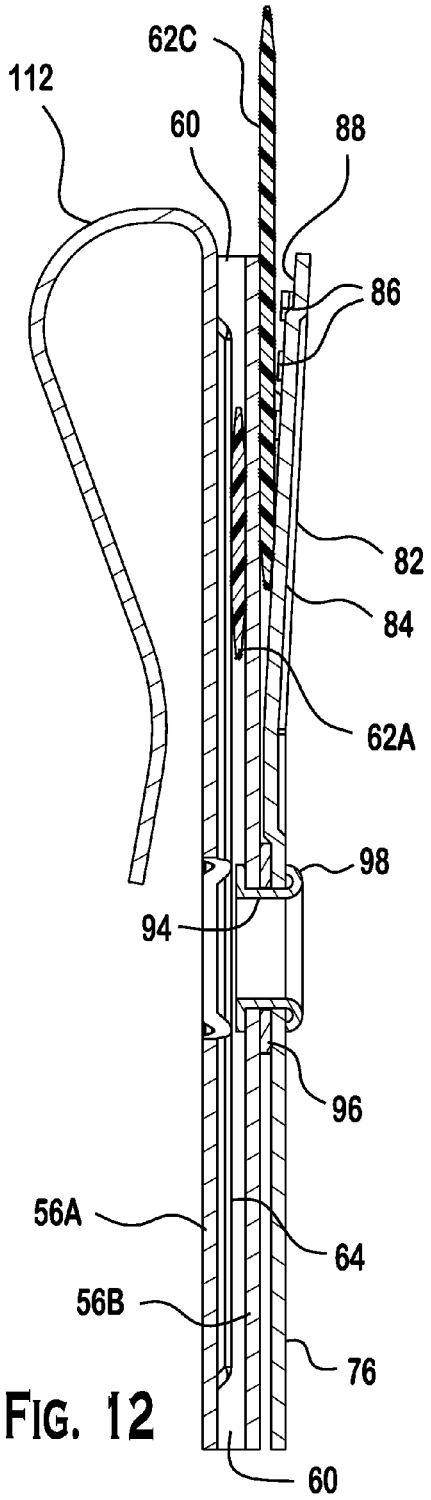
FIG. 12 is a left side elevational cross sectional view of the pick holder 50 of FIG. 3 demonstrating that a pick 62E inserted into the second gap 80 between the holder body 54 and face plate 76 such that the prongs 86 and second linear deformations 84 rest on said pick 62E. The face plate 76 is preferably affixed to the holder body 54 by a single central fastener 78. This configuration causes the elongated portion 82 to bend generally outward such that the springing action of the elongated portion 82 biases the pick 62E to remain within the second gap 80.
Figure 13:
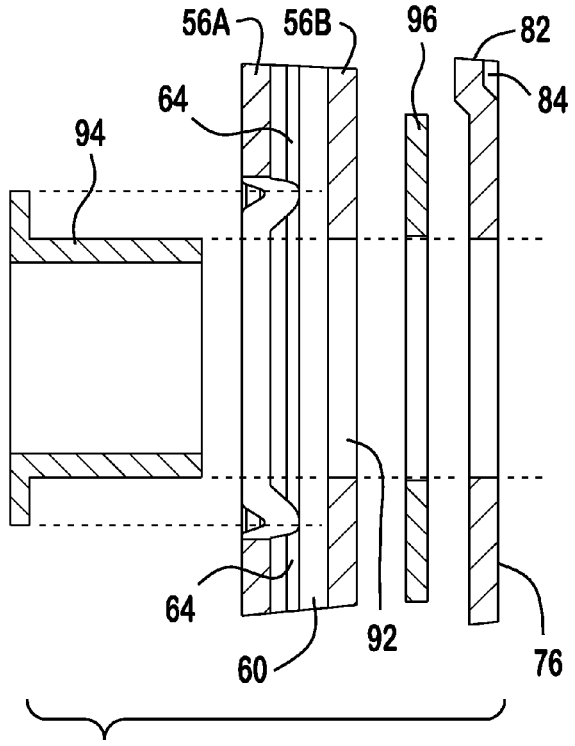
FIG. 13 is an exploded cross sectional view of the pick holder 50 of FIG. 3 demonstrating that in the preferred embodiment the fastener 78 may include a rivet 94 inserted into a single bore 92 through the holder body 54, flat rivet 94, and face plate 76. Those of ordinary skill in the art will appreciate from this disclosure that any suitable joining means can be used with the components of the pick holder 50 without departing from the scope of the present invention.
Figure 14:
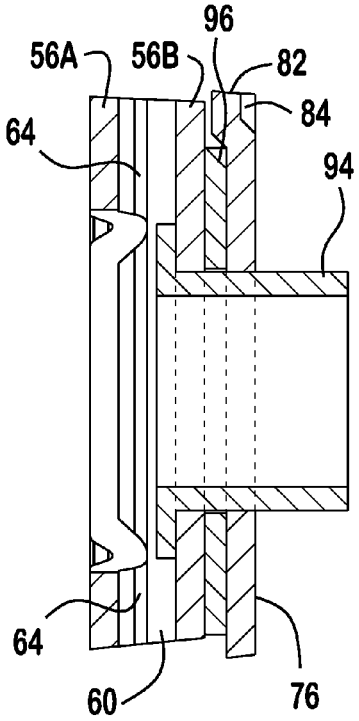
FIG. 14 is a similar view of the pick holder 50 to that of FIG. 13 demonstrating that in the preferred embodiment the fastener 78 may include a rivet 94 which is inserted into a single bore 92 through the holder body 54, flat rivet 94, and face plate 76, wherein the rivet 94 extends outward over the outer face of the face plate 76. This is one possible assembled state of the pick body 50 shown in FIG. 13.
Figure 15:
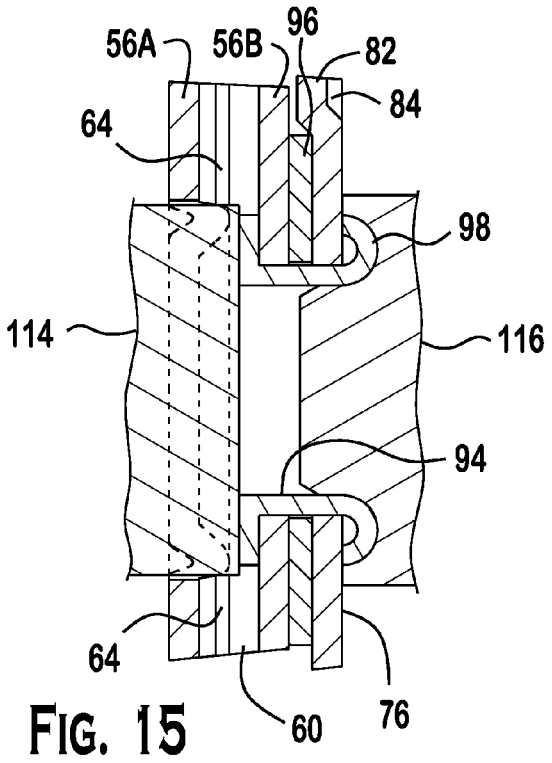
FIG. 15 is a cross sectional view of the pick holder 50 of FIG. 3 similar to that of FIG. 14 demonstrating that in the preferred embodiment the fastener 78 includes a rivet 94 which is inserted into a single bore 92 through the holder body 54, flat rivet 94, and face plate 76, wherein force can be imparted on both axial ends of the rivet 94, causing one end to bend inward toward the face plate 76 forming a lip 98 to hold the face plate 76 on the holder body 54. An anvil 114 and a die 116 can be used to deform the rivet 94 to form a lip 98 which extends radially outwardly from the single bore 92 to form a lip 98 over a portion of the face plate 76.
Figure 16:
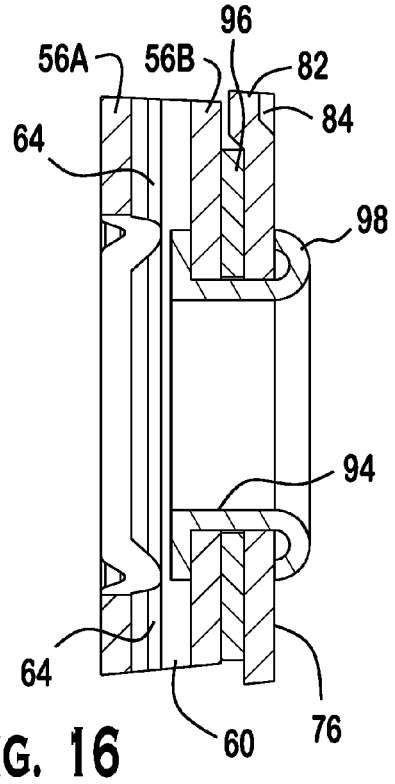
FIG. 16 is a cross sectional view of the pick holder 50 of FIG. 15 demonstrating that the fastener 78 includes a rivet 94 which is inserted into the single bore 92 through the holder body 54, flat rivet 94, and face plate 76, holds the face plate 76 on to the holder body 54 due to the lip 98 formed by the bent outer edge of the rivet 94.
Figure 17:
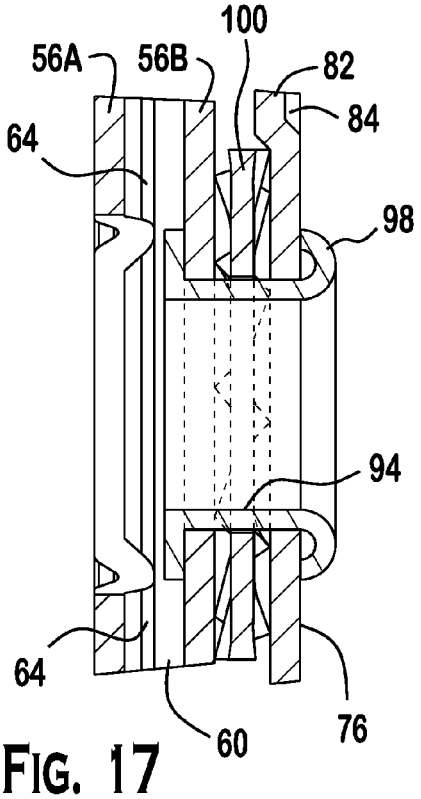
FIG. 17 is a cross sectional view of a fourth preferred embodiment of the pick holder 50 of the present invention demonstrating that the fastener 78 can include a star lock washer 100 in the place of a flat washer 96.
Figure 18:
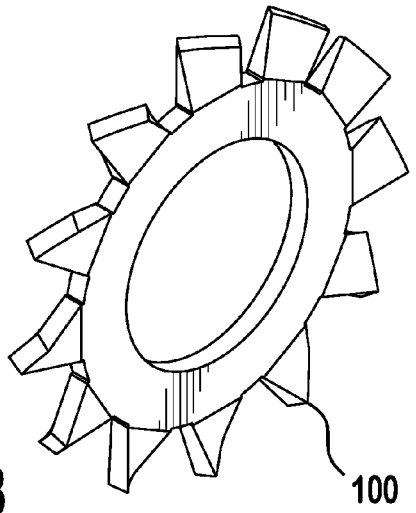
FIG. 18 is a front perspective view of the star lock washer 100.
Figure 19:
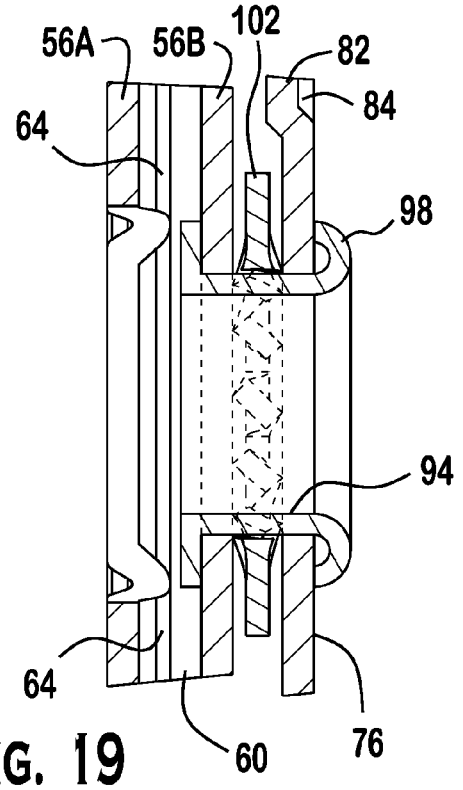
FIG. 19 is a cross sectional view of a fifth preferred embodiment of the pick holder 50 of the present invention demonstrating that the fastener 78 can include an internal star lock washer 102 in the place of a flat washer 96.
Figure 20:
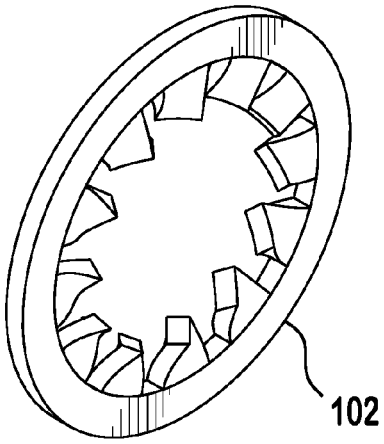
FIG. 20 is a front perspective view of the internal star lock washer 102.
Figure 21:
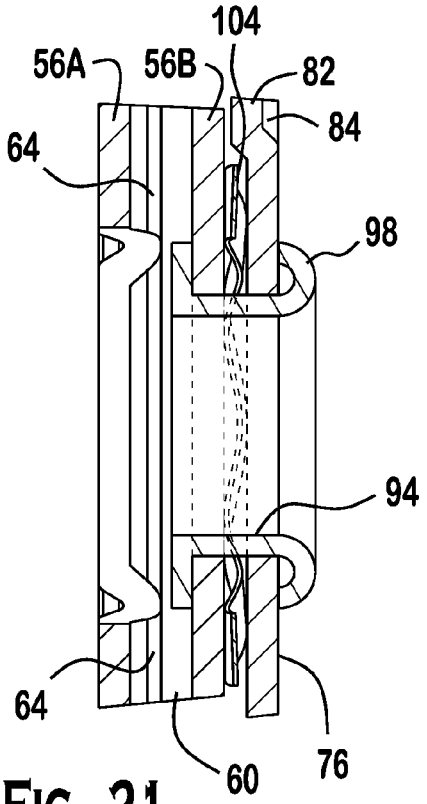
FIG. 21 is a cross sectional view of a sixth preferred embodiment of the pick holder 50 of the present invention demonstrating that the fastener 78 can include a wave washer 104 in the place of a flat washer 96.
Figure 22:
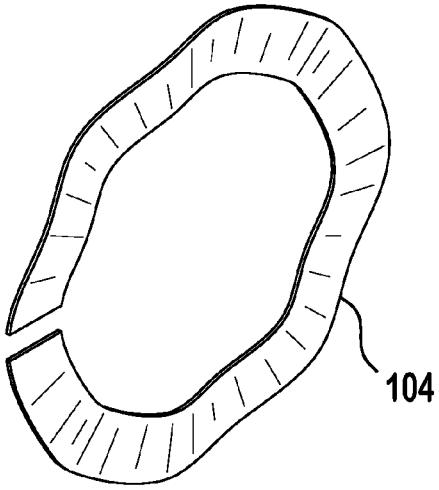
FIG. 22 is a front perspective view of the wave washer 104.
Figure 23:
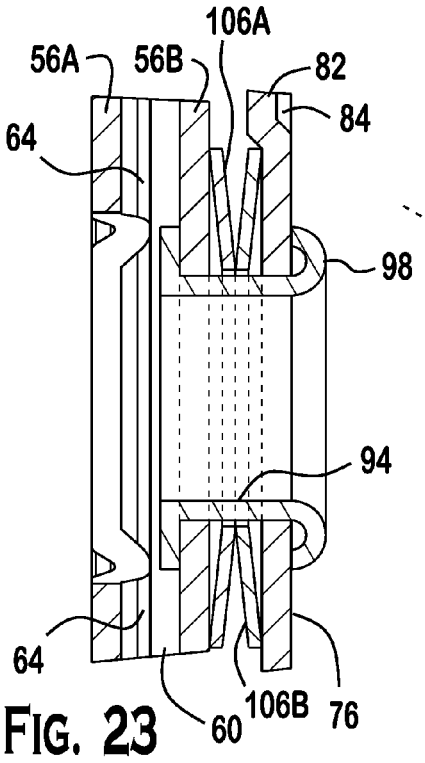
FIG. 23 is a cross sectional view of a seventh preferred embodiment of the pick holder 50 demonstrating that the fastener 78 can include conical washers 102 in the place of a flat washer 96.
Figure 24:
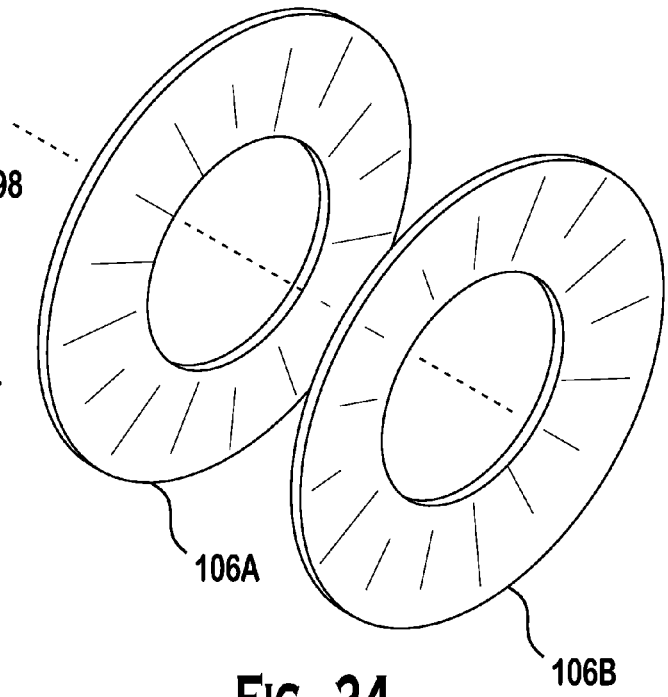
FIG. 24 is an exploded front perspective view of conical washers 106A and 106B demonstrating how the conical washers 106 should be configured to provide the required space between the face plate 76 and holder body 54 to form a second gap 80.
Figure 25:
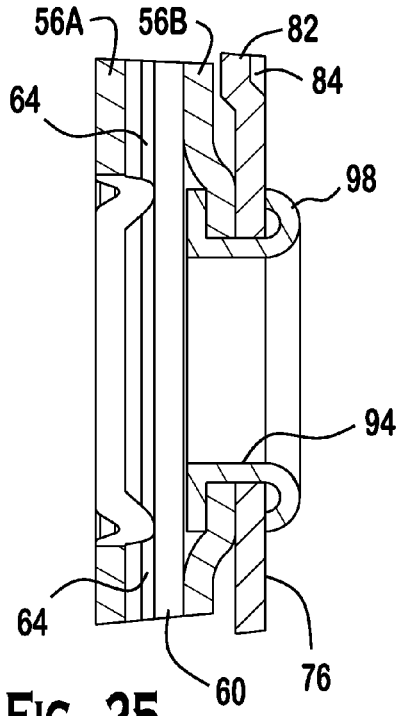
FIG. 25 is a cross sectional view of an eighth preferred embodiment of the pick holder 50 of the present invention demonstrating that the fastener 78 can be formed by only of a rivet 94 placed into a single bore 92 and bent to form a lip 98, wherein the second gap 80 is formed due to deformations of the second sidewall 56B which can be configured to bend generally outward about the single bore 92, and wherein the rivet 94 does not extend the full width of the single bore 92 of the pick holder 50, but instead begins in the first gap 60 and ends above the face plate 76, without touching the first sidewall 56A.
Figure 26:
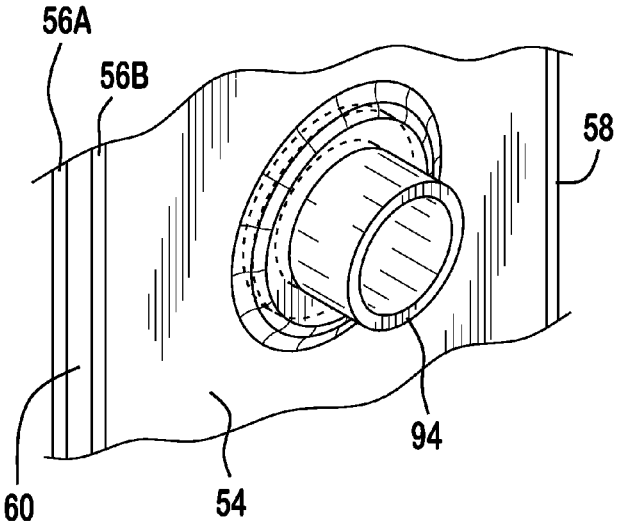
FIG. 26 is a front perspective view of the pick holder 50 with the fastener formed by only of a rivet 94 placed into a single bore 92 and the second gap 80 formed due to deformations of the second sidewall 56B which can be configured to bend generally outward about the single bore 92, demonstrating the appearance of the second sidewall 56B when deformed to create space such that a second gap 80 is formed. The dashed line demonstrates where the lip 98 would form when the rivet 94 is depressed to form said lip 98.
Figure 27:
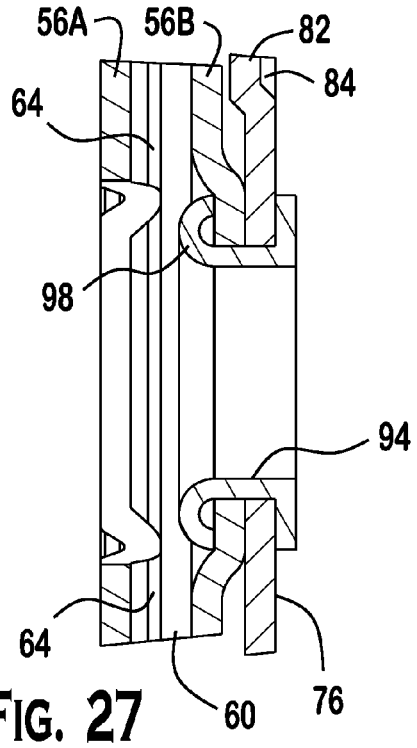
FIG. 27 is a cross sectional view of a ninth preferred embodiment of the pick holder 50 of the present invention demonstrating that the fastener 78 can be formed only of a rivet 94 placed into a single bore 92 and bent to form a lip 98, wherein the second gap 80 is formed due to deformations of the second sidewall 56B which can be configured to bend generally outward about the single bore 92, and wherein the lip 98 of the rivet 94 is formed within the holder body 54 rather than on the outer face of the face plate 76.
Figure 28:
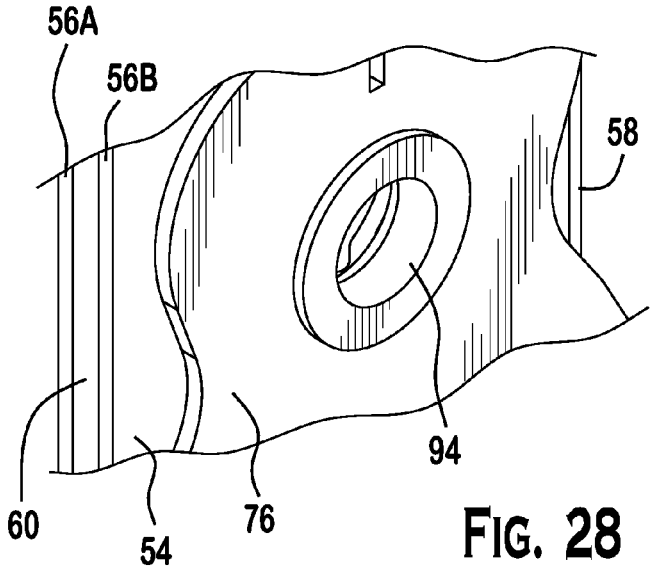
FIG. 28 is a front perspective view of the pick holder 50 of FIG. 27 with the fastener 78 formed by only a rivet 94 placed into a single bore 92 and bent to form a lip 98, wherein the second gap 80 is formed due to deformations of the second sidewall 56B which can be configured to bend generally outward about the single bore 92, and wherein the lip 98 of the rivet 94 is formed within the holder body 54 rather than on the outer face of the face plate 76, demonstrating the external appearance of the fastener 78 when the lip 98 is formed within the holder body 54.
Figure 29:
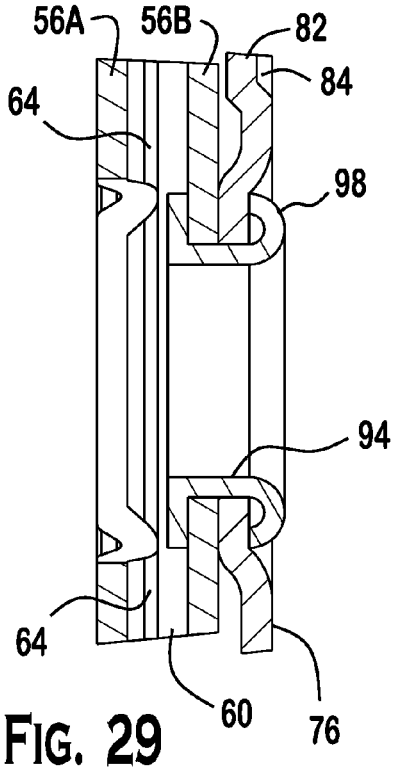
FIG. 29 is a cross sectional view of a tenth preferred embodiment of the pick holder 50 of the present invention demonstrating that the fastener 78 can be formed by only a rivet 94 placed into a single bore 92 and bent to form a lip 98, wherein the second gap 80 is formed due to deformations of the face plate 76 which can be configured to bend generally inward about the single bore 92.
Figure 30:
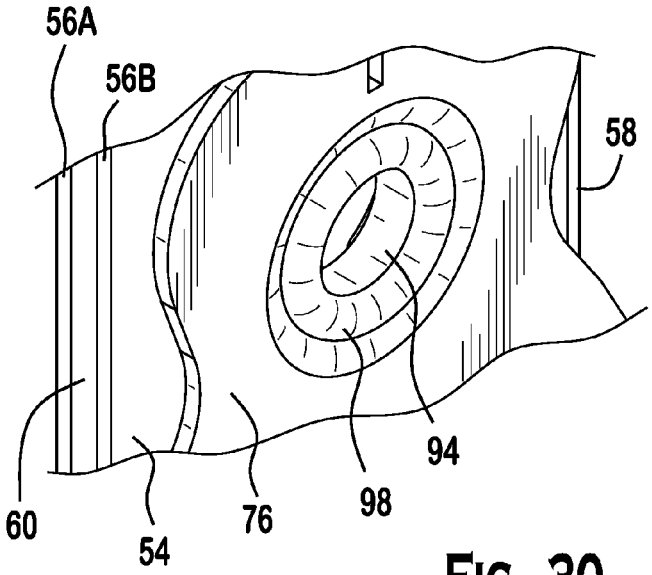
FIG. 30 is a front perspective view of the pick holder 50 of FIG. 29 with the fastener formed by only a rivet 94 placed into a single bore 92 and the second gap 80 formed due to deformations of the face plate 76 which can be configured to bend generally inward about the single bore 92, demonstrating the external appearance of the face plate 76 when deformed to create space such that a second gap 80 is formed.
Figure 31:
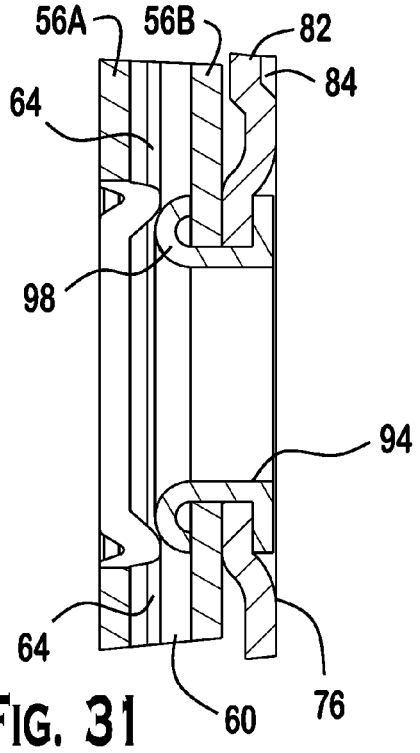
FIG. 31 is a cross sectional view of an eleventh preferred embodiment of the pick holder 50 demonstrating that the fastener 78 can be formed by only a rivet 94 placed into a single bore 92 and bent to form a lip 98, wherein the second gap 80 is formed due to deformations of the face plate 76 which can be configured to bend generally inward about the single bore 92, and wherein the lip 98 of the rivet 94 is formed within the holder body 54 rather than on the outer face of the face plate 76.
Figure 32:
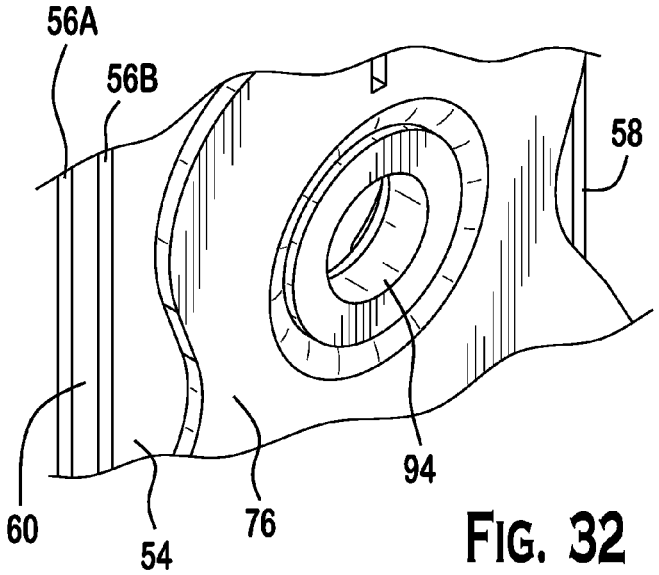
FIG. 32 is a front perspective view of the pick holder 50 of FIG. 31 with the fastener formed by only a rivet 94 placed into a single bore 92 and the second gap 80 formed due to deformations of the face plate 76 which can be configured to bend generally inward about the single bore 92, and wherein the lip 98 of the rivet 94 is formed within the holder body 54 rather than on the outer face of the face plate 76, demonstrating the external appearance of the face plate 76 when deformed to create space such that a second gap 80 is formed.
Figure 33:
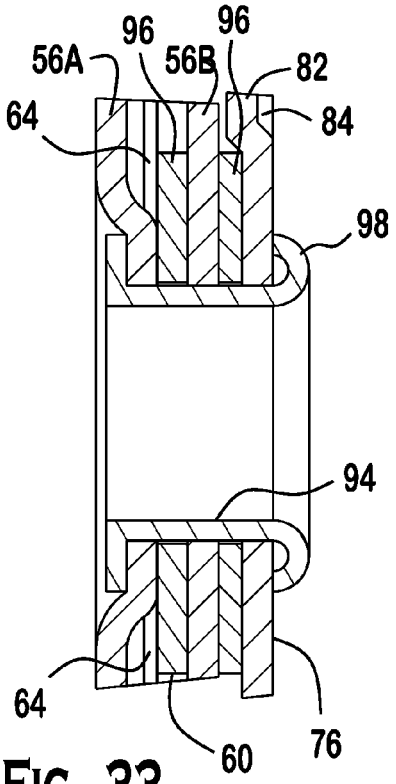
FIG. 33 is a cross sectional view of a twelfth preferred embodiment of the pick holder 50 in which the fastener 78 may include a flat washer 96 between the first sidewall 56A and second sidewall 56B and a flat washer 96 between the holder body 54 and the face plate 76, to maintain the space needed for the first gap 60 and second gap 80 to form respectively, as well as a rivet 94 inserted through a single bore 92 through the holder body 54, the flat washers 96, and the face plate 76, with the upper edge of the rivet 94 depressed to form a lip 98.
Figure 34:
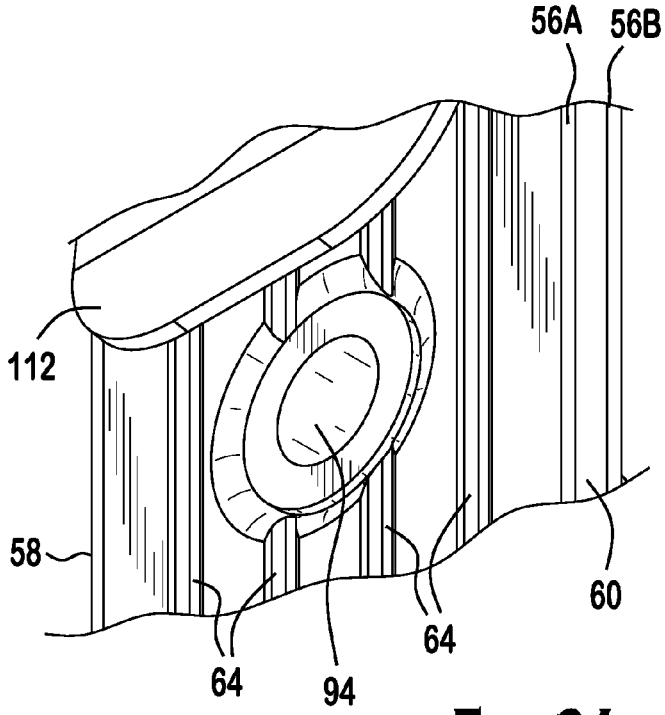
FIG. 34 is a partial rear perspective view of the holder body 54 of FIG. 33, demonstrating that the outer edge of the first sidewall 56A may be depressed about the single bore 92 such that the edge of the rivet 94 is below the level of the outer edge of the first sidewall 56A, allowing material to be slid along the outer edge of the first sidewall 56A and under the clip member 112 without catching on the rivet 94.
Figure 35:
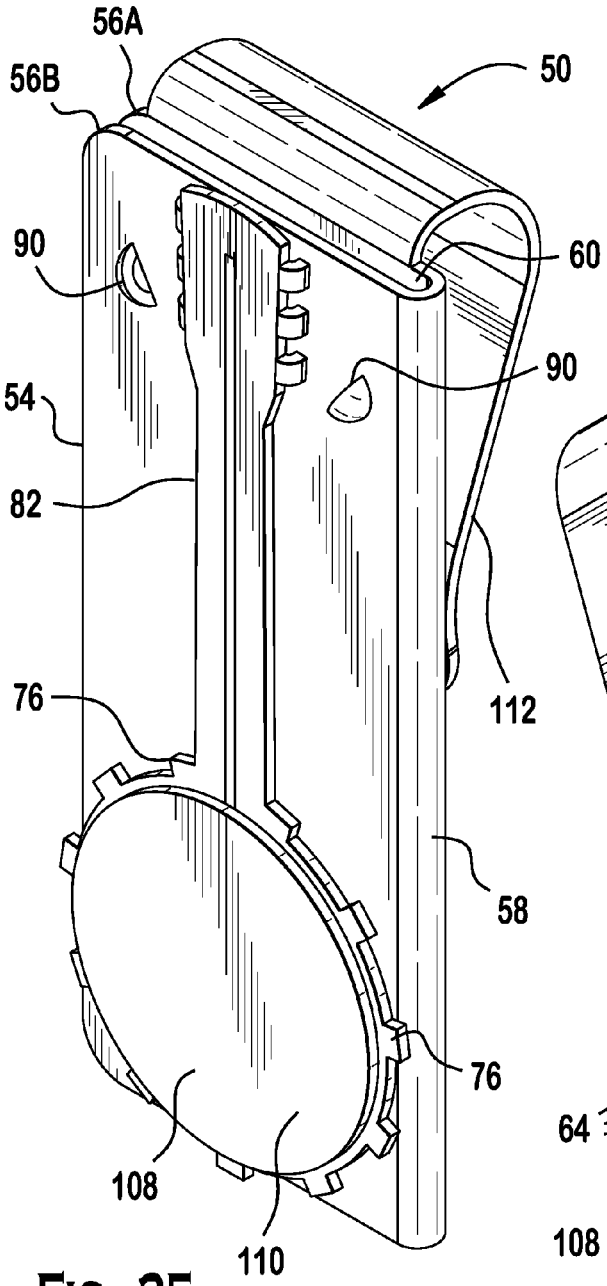
FIG. 35 is a front perspective view a thirteenth embodiment of the pick holder 50 of the present invention which demonstrates the pick holder 50 including a holder body 54 including two sidewalls 56 which form a first gap 60 and may be conjoined by a lateral wall which may span an entire side of the sidewalls 56. A clip member 112 may be affixed to this holder body 54. In this preferred embodiment, a second gap 80 is formed between the holder body 54 and a face plate 76 which is affixed to the holder body 54 via a fastener 78. The face plate 76 may be shaped similar to a the outline of a banjo, include an elongated portion 82 which extends upwards such that it covers only an edge 88 of a pick 62 present in the second gap 80. The elongated portion 82 may further include second linear deformations 84 and or prongs 88 which extend into the second gap 80 to bias a pick 62 to remain therein. The holder body 50 may further include abutments 90 affixed to the outer surface of the second sidewall 56B and extending into the second gap 80 such that they abut the pick 62 and prevent more than half of the pick 62 from being covered by the elongated portion 82 of the face plate 76.
Figure 36:
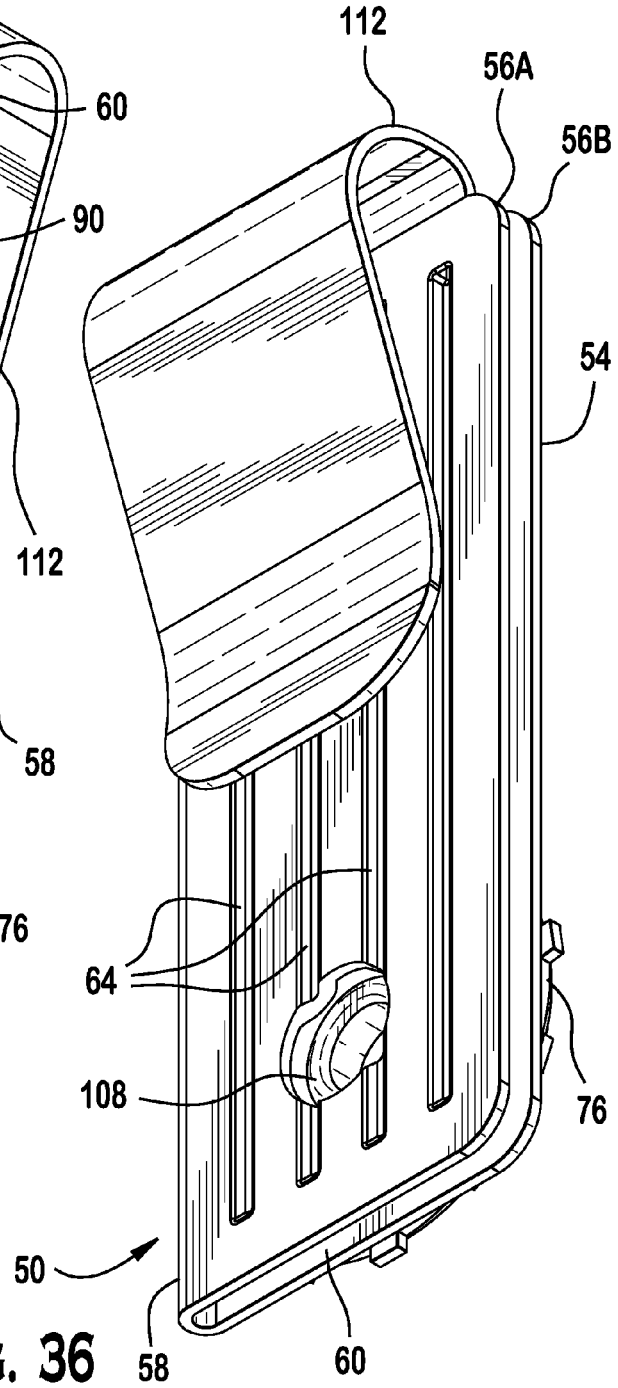
FIG. 36 is a rear perspective view of the pick holder 50 of FIG. 35 which demonstrates another embodiment of the pick holder including a holder body 54 including a first sidewall 54A and a second sidewall 54B. In this, the first sidewall 54A may include first linear deformations 64 which may protrude into the first gap 60 to facilitate securing picks 62 which have been inserted into the first gap 60 to remain therein.

Referring to FIGS. 3, 4, and 10, the pick holder 50 preferably includes a holder body 54 which includes first and second sidewalls, 56A and 56B, with the second sidewall 56B being the sidewall configured to face outward. The sidewalls 56 are preferably configured to be generally parallel to one another such that the sidewalls 56 form a first gap 60 therebetween, in which one or more picks 62 may be partially inserted and secured therein. The sidewalls 56 may be connected by a lateral wall 58. The lateral wall 58 preferably extends the entire length of any one edge of the sidewalls 56, is preferably U-shaped, and is preferably formed of a flexible material such that the sidewalls 46 might push generally outward through the bending of the lateral wall 58 when a pick 62 is partially inserted, such that a portion of the pick remains therein. This flexing of the lateral wall 58 may cause the lateral wall 58 to attempt to return to its original form once the pick 62 is inserted, thus applying inward force on the sidewalls 56 which is transferred to the pick 62, holding it in place. Those of ordinary skill in the art will appreciate from this disclosure that the lateral wall 58 need not extend the entire length of any side of the sidewalls 56, nor must the lateral wall be U-shaped to hold a pick 62 within the first gap. In the preferred embodiment, the first gap 60 is free of any divider connecting the first and second sidewalls. However, those of ordinary skill in the art would appreciate from this disclosure that dividers could be present without exceeding the scope of this invention.

Referring to FIGS. 6-9, other means for biasing a pick 62 within the first gap 60 may include the inclusion of one or more first linear deformations 64 in one or more of the sidewalls 56 which may protrude inward into the first gap 60; the inclusion of an elastomer layer 66 disposed within the first gap 60 and connected to at least one of the sidewalls 56 to better secure a pick 62 within the first gap 60; or the inclusion of spring elements, which in the preferred embodiment includes one or more leaf springs 68, including a quarter-elliptic spring body 70 formed of a flexible or semi-flexible metal or plastic material, a cavity 72, and a distal end 74, configured such that when pick 62A is inserted into the first gap 60, the pick 62A causes the quarter-elliptic spring body 70 to flex into the cavity 72, with the quarter-elliptic spring body 70 biasing the pick 62A to remain in the first gap 60 through the spring action of the leaf spring 68 as the quarter-elliptic spring body 70 attempts to return to its original quarter-elliptic shape. Those with ordinary skill in the art will appreciate from this disclosure that other flexible materials and other spring structures may be substituted for metal and leaf springs, respectively, without departing the scope of this invention.

Figure 37:
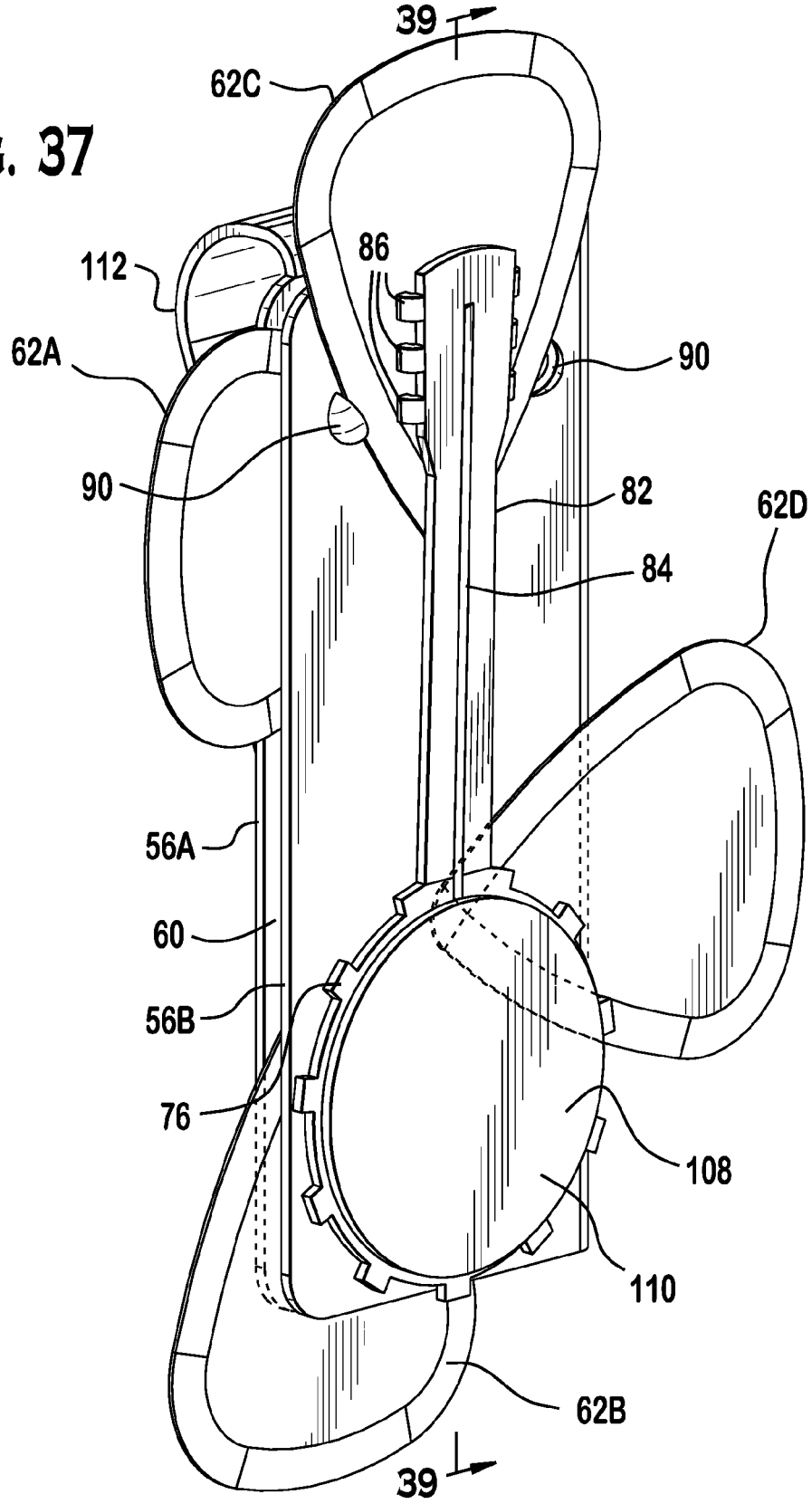
FIG. 37 is front perspective view of the pick holder 50 of FIG. 35 wherein the face plate 76 may be configured in the shape of a banjo demonstrating that picks 62 may held within the pick holder 50 on varying planar levels and in varying orientations. Picks 62A and 62B are held within the first gap 60 on the same planar level, but with pick 62A in a right-facing orientation and pick 62B in an upward-facing orientation. Picks 62C and 62D are on a second planar level, being held in the second gap 80, but are in different orientations, with pick 62C in a downward-facing orientation and pick 62D in a left-facing orientation. Each of the picks 62 can be placed into the pick holder 50 through different insertion paths, and any one of the picks 62 may be removed without dislodging or causing any other pick to move.
Figure 38:
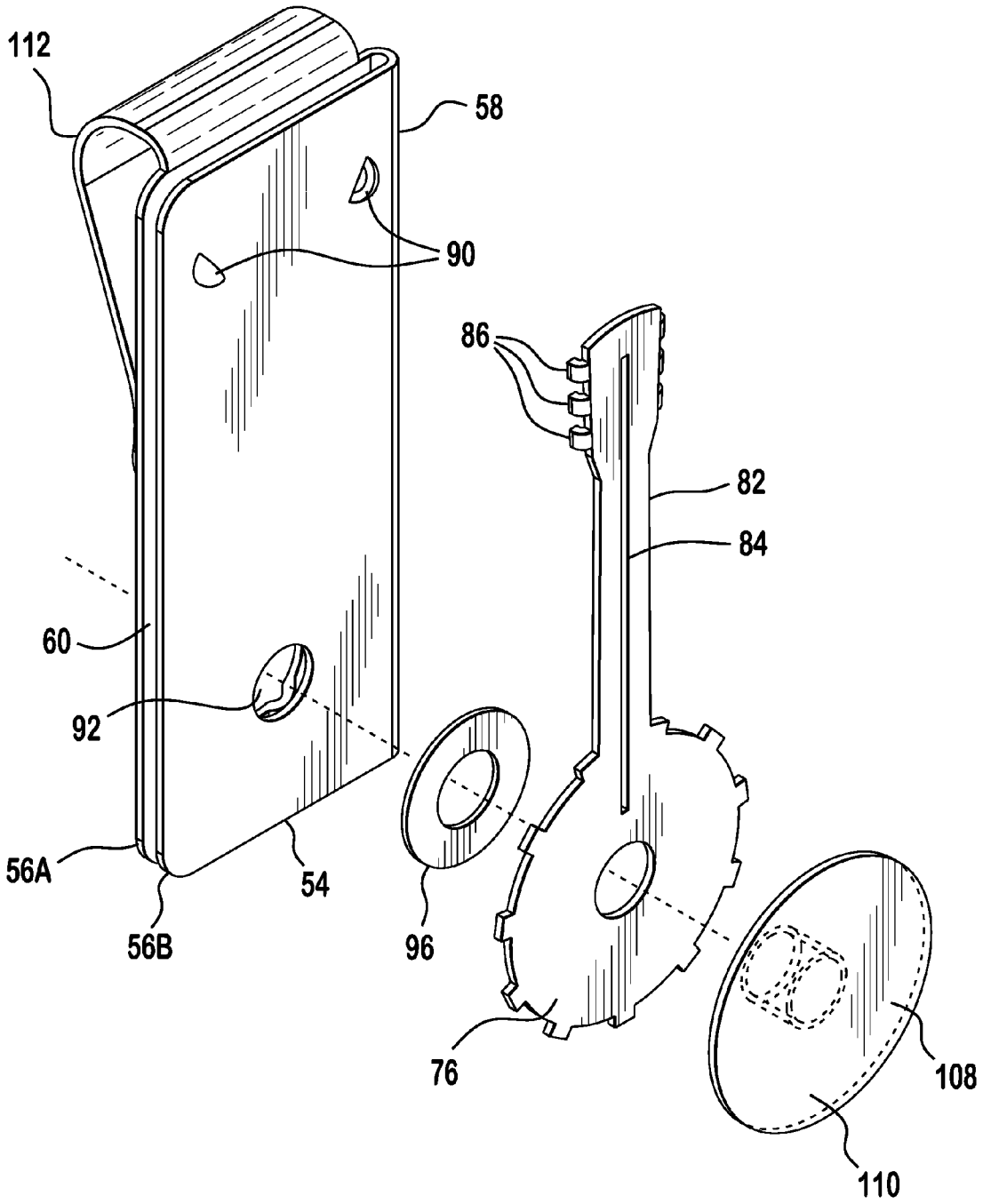
FIG. 38 is an exploded front perspective view of the pick holder 50 of FIG. 35 demonstrating that in another embodiment, the face plate 76 is affixed to the holder body 54 by a fastener 78 which is inserted through a single bore 92 through the face plate 76, holder body 54, and a flat washer 96, with the flat washer 96 providing space to form the second gap 80, and wherein the fastener 78 includes a pate rivet 110 in place of rivet 94, such that the single bore 92 is not visible and such that the plate rivet 110 covers a portion of the face plate 76.
Figure 39:
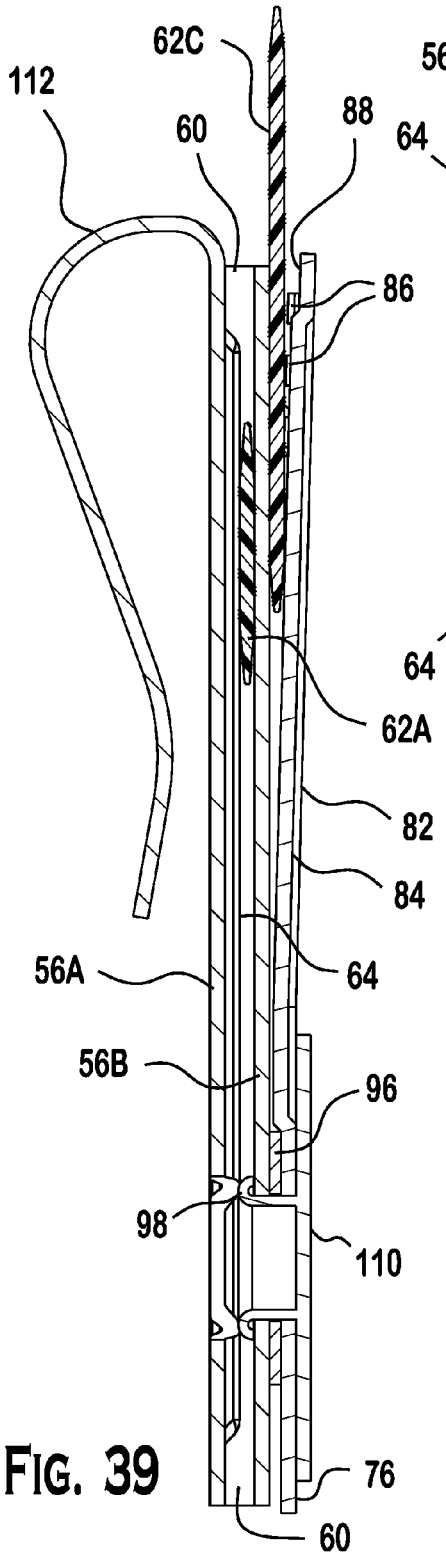
FIG. 39 is a left side cross sectional view of the pick holder 50 as taken along the lines 39-39 in FIG. 37 demonstrating that a pick 62E inserted into the second gap 80 between the holder body 54 and face plate 76 such that the prongs 86 and second linear deformations 84 rest on said pick 62E. The face plate 76 is preferably affixed to the holder body 54 by a single fastener 78, positioned generally centrally and near the bottom of the face plate 76. This configuration causes the elongated portion 82 to bend generally outward such that the springing action of the elongated portion 82 biases the pick 62E to remain within the second gap 80.
Figure 40:
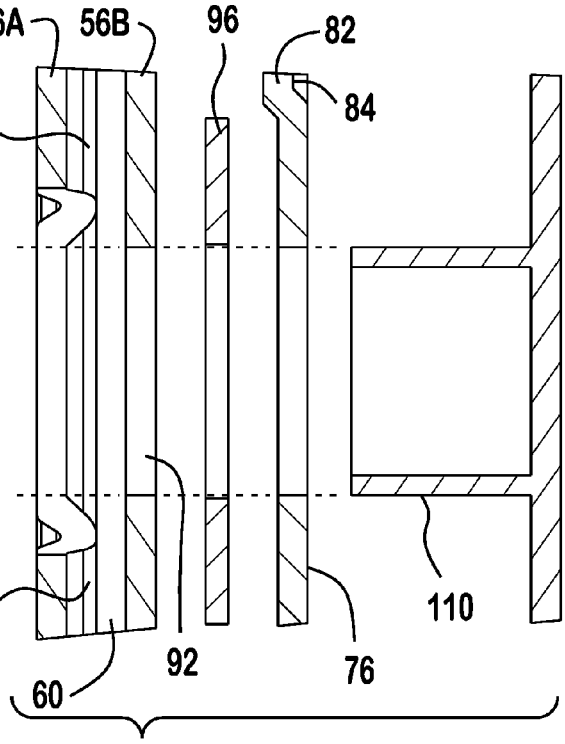
FIG. 40 is an exploded cross sectional view of the pick holder 50 of FIG. 39 demonstrating that in another embodiment the fastener 78 includes a plate rivet 110 placed atop the face plate 76 and inserted into a single bore 92 through the holder body 54, flat rivet 94, and face plate 76.
Figure 41:
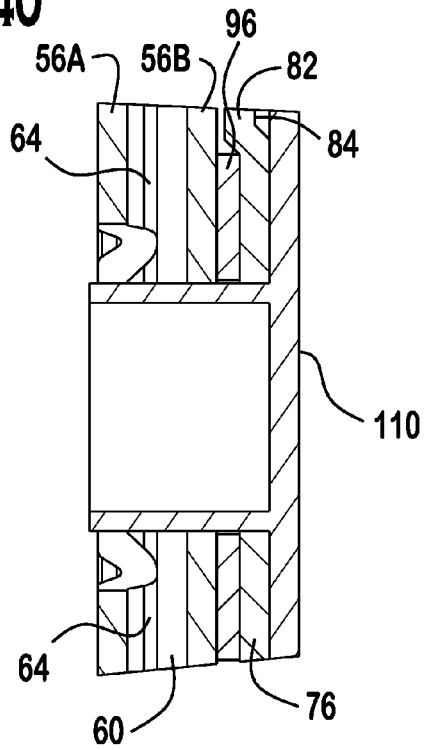
FIG. 41 is a cross sectional view of the pick holder 50 of FIG. 40 demonstrating that, in another embodiment, the fastener 78 includes a plate rivet 110 placed atop the face plate 76 and inserted into a single bore 92 through the holder body 54, flat rivet 94, and face plate 76, wherein the plate rivet 110 extends inward such that it protrudes slightly through the first sidewall 56A.
Figure 42:
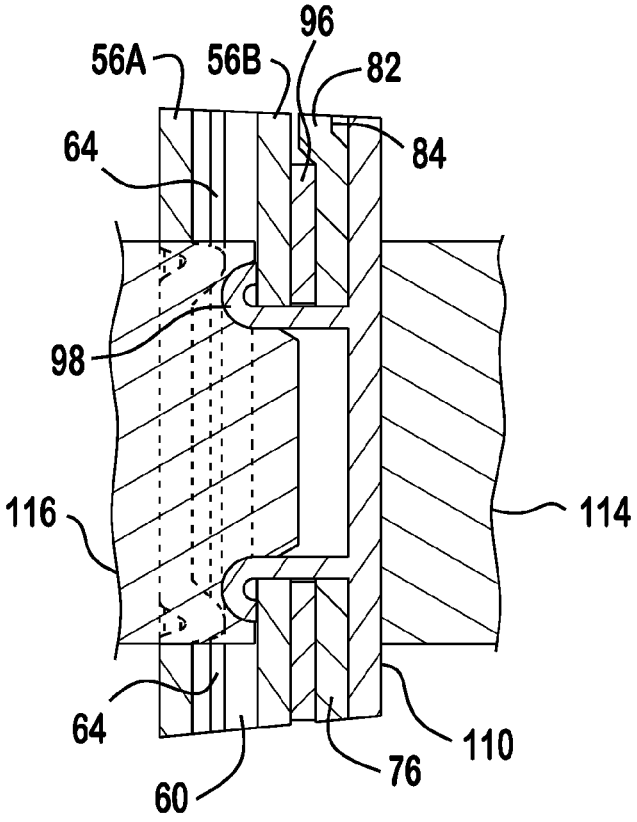
FIG. 42 is a cross sectional view of the pick holder 50 of FIG. 39 demonstrating the anvil 114 and die 116 being used in the formation thereof. The dashed lines show the back side of the bore that is covered by the tools, anvil and die. In another embodiment, the fastener 78 includes a plate rivet 110 placed atop the face plate 76 and inserted into a single bore 92 through the holder body 54, flat rivet 94, and face plate 76, wherein force can be imparted on both axial ends of the plate rivet 110, causing the end protruding through the first sidewall 56A to bend forming a lip 98 to hold the face plate 76 on the holder body 54.
Figure 43:
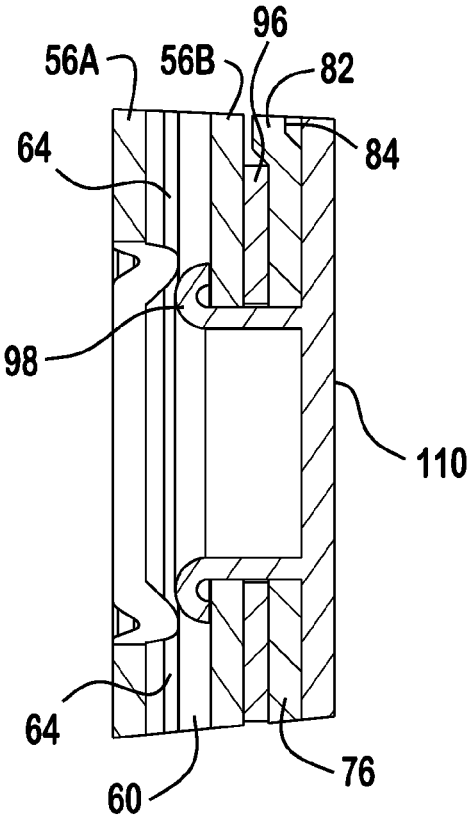
FIG. 43 is a cross sectional view of the pick holder 50 of FIG. 39 demonstrating that, in another embodiment, the fastener 78 includes a plate rivet 110 placed atop the face plate 76 and inserted into a single bore 92 through the holder body 54, flat rivet 94, and face plate 76, wherein the face plate 76 is affixed to the holder body 54 due to the lip 98.

Referring to FIGS. 10 and 37, the first gap 60 is preferably configured such that picks 62 may be partially inserted into the first gap 60 such that they are detachably secured therein. As can be seen in FIGS. 10 and 37, picks 62A and 62B can be held within the first gap 60 on a common plane but in different angular orientations, with pick 62A oriented the left and pick 62B oriented upwards. The sidewalls 56 are preferably configured such that individual picks 62 can be inserted via different insertion paths from one another. By way of illustration, pick 62A may be inserted following an insertion path which tracks generally left to right or some angular variation of such a path, while pick 62B may be inserted following an insertion path which tracks generally upward or some angular variation therefrom.

Referring to FIGS. 3, 4, 10, 12, and 39, the preferred embodiment of the pick holder 50 may further includes a face plate 76 affixed to the second sidewall 56B. In the preferred embodiment, the face plate 76 is preferably affixed to the second sidewall 56B, through the use of an affixing means such as a single fastener 78 discussed in further detail below. Those of ordinary skill in the art will appreciate from this disclosure that any number of fasteners may be present without exceeding the scope of this invention. The face plate 76 is preferably configured such that a second gap 80 is formed between the face plate 76 and the second sidewall 56B which is generally parallel to the first gap 60, wherein picks 62 can be detachably secured partially within the second gap 80. In this preferred configuration, picks 62C and 62D may be positioned in the second gap 80 and picks 62A and 62B may be positioned in the first gap 60 such that picks 62C and 62D may be on the same planar level as each other and may overlap with at least a portion of picks 62A and 62B respectively while simultaneously being held on a generally parallel level to the planar level of said picks. This preferable configuration allow picks 62C to be removed from the pick holder 50 without moving other picks or causing picks 62A, 62D, or 62B to be removed, and allowing any other pick to be removed without moving other picks or causing any other pick to be removed.

Referring again to FIGS. 3, 4, 10, 12, 35, 36, and 39, the face plate 60 preferably includes an elongated portion 82 configured to cover a corner portion of a pick 62C inserted in the second gap 80 below the elongated portion 82, such that preferably less than half of the pick 62C is covered by the elongated portion 82. In the preferred embodiment, the face plate 76 is formed in the shape of a guitar, with the elongated portion 82 forming the neck of the guitar shape. In another preferred embodiment, the face plate 76 is formed in the shape of a banjo, with the elongated portion 82 forming the neck of the banjo shape. Those with ordinary skill in the art will appreciate from this disclosure that the face plate 76 can be provided in varying shapes, with or without an elongated portion 82, including circular, rectangular, and triangular shapes. The face plate 76 may further be configured such that it includes a slot in which various design elements may be placed to make the pick holder 50 more aesthetically appealing.

Referring to FIGS. 5-10, 12, and 39, the face plate 76 is preferably formed of flexible or semi-flexible material, such as plastic or a soft metal, such that the face plate 76 will bend generally outward when a pick 62 is partially inserted into the second gap 80, the spring action of the face plate 76 biasing the pick 62 to remain within the second gap 80. Those of ordinary skill in the art will appreciate from this disclosure that any suitable material can be used to form the face plate 76 without departing from the scope of the present invention. Other embodiments may include alternate or additional elements to retain picks 62 within the second gap 80, including: one or more second linear deformations 84 in the face plate 76 or the elongated portion 82 which protrudes into the second gap 80 to facilitate securing a pick 62 therein; one or more prongs 86 extending inward from an edge 88 of the face plate 76 or the elongated portion 82 and protruding into the second gap 80 and configured to engage the surface of the pick 62 and impart the spring action of the face plate 76 onto the pick 62, biasing the pick 62 to remain within the second gap 80; two abutments 90 affixed to the outer surface of the second sidewall 56B and configured to limit the insertion of the pick 62 into the second gap 80 by abutting each of the sides of the pick 62 which form the corner which is inserted into the second gap 80; or the inclusion of second elastomer layer within the second gap 80 and affixed to one or both of the second sidewall 56B and the face plate to bias a pick 62 to remain partially inserted into the second gap 80.

Referring to FIGS. 11-34 and 38-43, the face plate 76 is preferably affixed to the second sidewall 56B through the use of a fastener 78. In the preferred embodiment, this fastener 76 may include a single bore 92 through the holder body 54 and face plate 76, wherein a rivet 94, having a hollow center, is inserted into the bore 92 from the outer surface of the first sidewall 56A such that the rivet 94 extends through the first and second sidewalls 56A and 56B, through a flat washer 96, and through the face plate 76 such that the a hole remains throughout the entirety of the pick holder 50. In some embodiments, more than one flat washer 96 may be present, including embodiments in which one flat washer 96 is placed with the first sidewall 56A and the second sidewall 56B such that it is held within the first gap 60, and a flat washer 96 is also held between the holder body 54 and the face plate 76. The fastener 78 may be further configured such that the portion of the rivet 94 which extends through the face plate is deformed out ward such that it forms a lip 98 about the single bore 92, affixing the face plate 76 to the holder body 54. In other embodiments, the rivet 94 may be positioned through the single bore 92 such that a portion of the rivet extends through the outer edge of the first sidewall 56A and pressure may be imparted onto it such that the lip 98 is formed within the first gap 60 rather than against the surface of the face plate 76. In other embodiments, the rivet 94 may originate from within the first gap 60 such that it does next extend through the entire single bore 92 of the pick holder 50. In other embodiments, the other spacers may be included instead of the flat washer 96 which might better prevent the face plate 76 from moving from a fixed position such as star lock washers 100, internal star lock washers 102, wave washers 104, conical washers 106 inverted upon each other to provide greater spacing, or any other spacing means.

Referring to FIGS. 27-31, other embodiments of the fastener 78 include a lack of the spacers disclosed above, such as a flat washer 96, star lock washers 100, internal star lock washers 102, wave washers 104, or conical washers 106 inverted upon each other. Instead, these embodiments utilize deformations of the second sidewall 56B or face plate 76 to achieve the formation of a second gap 80. In one embodiment, the second sidewall 56B may slope generally upward about the single bore 92, such that the second sidewall 56B may contact the face plate 76 generally higher than the overall surface of the second sidewall 56B, causing a second gap 80 to form. In another embodiment, the face plate 76 may slope generally downward about the single bore 92, such that the face plate 76 may contact the second sidewall 56B generally lower than the overall surface of the underside of the face plate 76, causing a second gap 80 to form. Those of ordinary skill in the art will appreciate form this disclosure that the deformities of the face plate 76 and the second sidewall 56B may be combined with other deformities of said elements or combined with the spacing means listed above and not exceed the scope of this disclosure.

Referring to FIGS. 38-43, a second preferred embodiment of the pick holder 50 may \include a second fastener 108 including a single bore 92 through the holder body 54 and face plate 76. In place of a rivet, the second fastener 108 includes a plate rivet 110, wherein a the upper portion of the plate rivet 110 includes a flat surface configured to sit flat along the outer edge of the face plate 76, and wherein the lower edge of the plate rivet 110 is configured to be thread through a spacer, such as a flat washer 96 or any other spacing means which might be utilized in the first embodiment, and through the single bore 92. The lower edge of the plate rivet 110 is further configured such that the bottom edge may be deformed along the rear edge of the single bore 92, such that a lip 98 is formed, holding the plate rivet 110 in place and affixing the face plate 76 to the holder body 54. Those with ordinary skill in the art will appreciate from this disclosure that any spacing mean may be included, and that the rivet 94 or plate rivet 110 may be inserted into the single bore 92 from the underside or upper side without exceeding the scope of this disclosure.

Referring to FIGS. 1-43, it is preferred that the face plate 76 be affixed to the holder body 54 by a single fastening means, including the fastener 78 or second fastener 106, positioned generally centrally on the major surface of the second sidewall 56B. However, other embodiments may include affixing the face plate 76 to the holder body 54 such that the face plate 76 is allowed to move in a planar perpendicular direction relative to a major surface of the second sidewall 56B, which may entail one or more hinges or other flexible fastening means affixed to at least one side edge of the second sidewall 56B to allow the face plate 76 to move in aid planar perpendicular direction.

Figure 5:
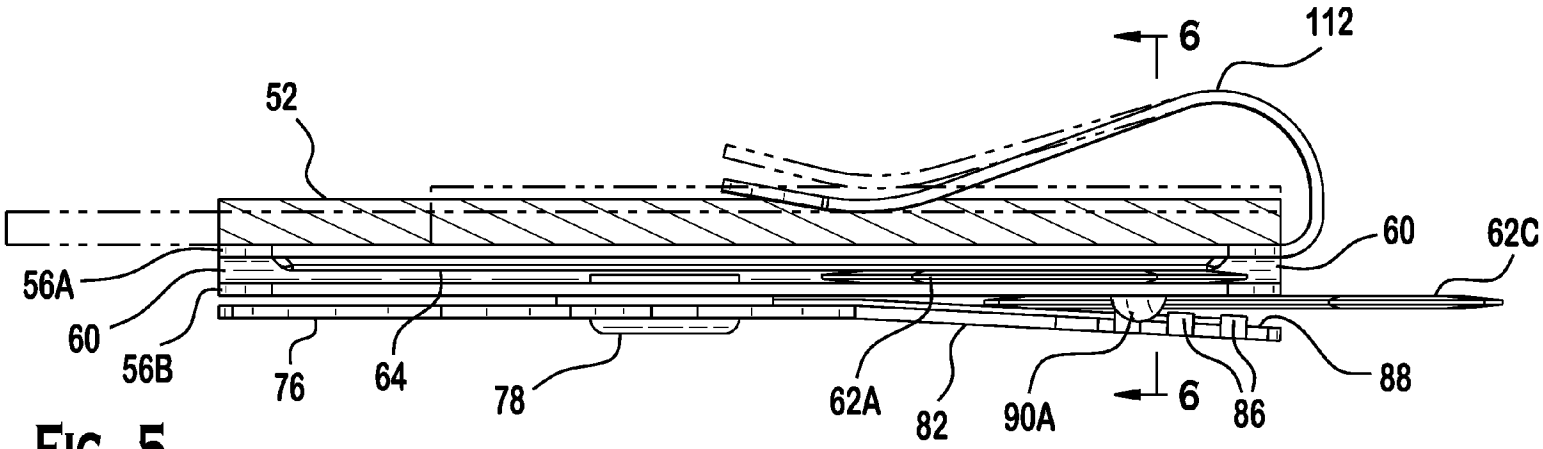
FIG. 5 is a left side cross sectional view of the pick holder 50 of FIG. 2 as taken along the lines 5-5 of FIG. 2 which demonstrates the preferred springing action of the clip member 112 which may hold the pick holder 50 on a guitar strap 52 or other surface. The figure further demonstrates that the prongs 86 of the elongated portion 82 of the face plate 76 are preferably configured to rest upon a pick 62 inserted into the second gap 80, causing the elongated portion 82 to bend generally outward, causing a springing action to be exerted onto the pick 62, biasing it to remain in the second gap 80. Dashed lines show possible placement of the guitar strap 52 and deformation of the clip member 112 which may occur thereby.
Figure 6:
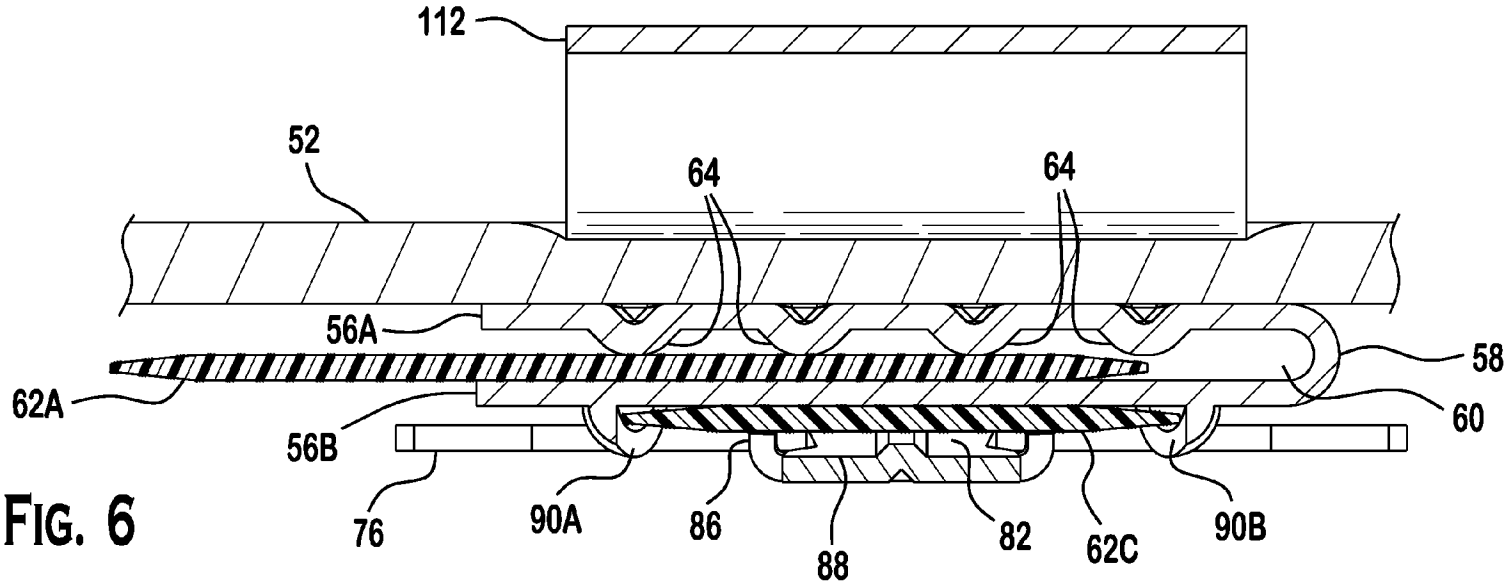
FIG. 6 is a top plan cross-sectional view of the pick holder 50 as taken along the lines 6-6 in FIG. 5 which demonstrates the function of the first linear deformations 64 in the first sidewall 56A which may extend into the first gap 60 to bias a pick 62 inserted into the first gap 60 to remain therein.
Figure 7:
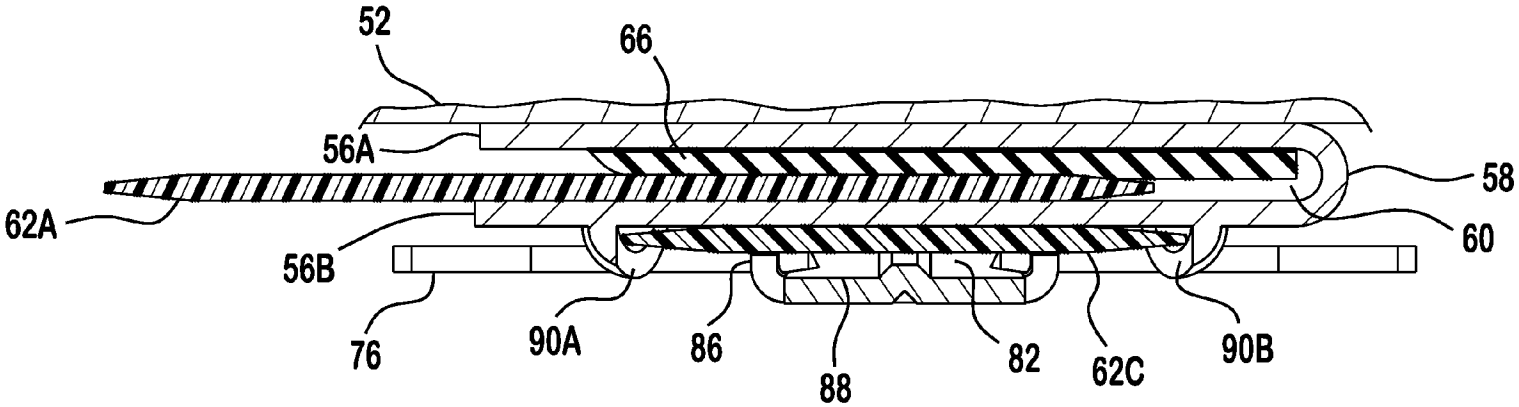
FIG. 7 is a top plan cross-sectional view of a second preferred embodiment of the pick holder 50 of the present invention which demonstrates use of an elastomer layer 66 to bias the picks 62 to remain detachably positioned within the first gap 60, wherein the elastomer layer 66 is included in the first gap 60 and affixed to at least one of the sidewalls 54 such that the pick 62 may be biased to remain within the first gap 60 due to the friction created by the elastomer layer 62 and the spring action of the sidewalls 54 being increased due to the additional outward force exerted onto the sidewalls 54 by the pick 62A due to the additional presence of the elastomer layer 66 within the first gap 60.
Figure 8:
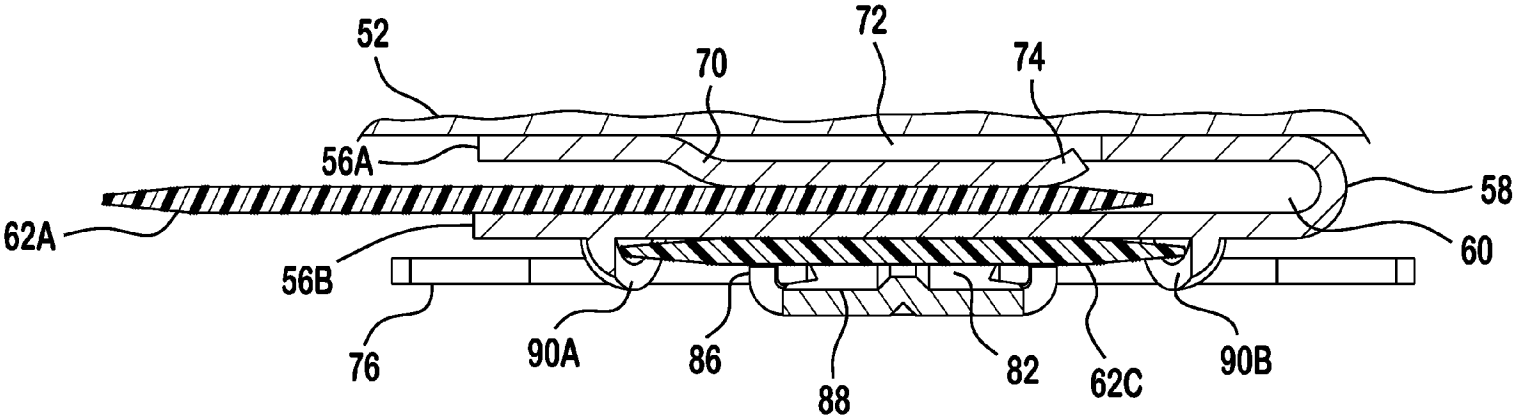
FIG. 8 is a top elevational view of a third preferred embodiment of the pick holder 50 of the present invention which demonstrates use of a leaf spring 68 to bias picks 62 to remain detachably positioned within the first gap 60, wherein the leaf spring 68 may include a quarter-elliptic spring body 70 and a distal end 74. The leaf spring 68 may flex into a cavity 72 when a pick 62 is inserted into the first gap until the distal end 74 strikes the rear surface of the first sidewall 56A, stopping the outward flex of the leaf spring 68, and the spring action of the leaf spring 68 may be imparted onto the pick 62, holding the pick 62 within the first gap 60. Alternatively, the leaf spring 68 may halt its deformation prior to striking another portion of the pick holder 50 if the spring force generated is sufficient to compensate for insertion of the pick into the pick holder 50.

Referring to FIGS. 1, 2, and 5, the preferred embodiment of the pick holder 50 includes a clip member 112, extending from the holder body 54 sloping outward and generally downwards to detachably secure the pick holder 50 to a guitar strap 52. Other means for affixing the pick holder to a guitar strap, belt or other surface, such as buttons, Velcro, or the like, may also be used. Those of ordinary skill in the art will appreciate from this disclosure that any of these affixing means or similar such means may be used to secure the pick holder to a guitar strap, belt, or other surface.

In another preferred embodiment, the fastener 78 may include any of the spacing means listed above, including a flat washer 96, star lock washer 100, internal star lock washer 100, wave washer 104, conical washer 106, deformities of the face plate 76 or second sidewall 56B, the single bore 92, and a rivet 94, wherein the rivet if formed of a threaded rear portion and a threaded front portion such that the rivet can be unscrewed and face plates 76 can be easily interchanged to enhance customizability of the pick holder 50. Those of ordinary skill in the art will appreciate from this disclosure that other fastening means for allowing face plates 76 to be interchangeable may be used without exceeding the scope of this invention.

What is claimed is:

1. A pick holder, comprising:

a holder body comprising first and second sidewalls, at least a portion of the first and second sidewalls are spaced apart and generally parallel planar so as to define a first gap therebetween, the first and second sidewalls being configured to allow each of a first plurality of picks to be detachably secured partially within the first gap along a common plane, the first and second sidewalls being configured such that at least some of the first plurality of picks can have a different angular orientation while secured in the holder body, the first and second sidewalls being further configured such that the first plurality of picks can be inserted into the pick holder using one of a first insertion path and a second insertion path, the first insertion path having a different orientation from the second insertion path.

2. The pick holder of claim 1, further comprising a lateral wall connecting the first and second sidewalls and extending between a first sidewall edge and a second sidewall edge.

3. The pick holder of claim 2, wherein the lateral wall has a U-shape and is connected between the entire lengths of the first and second sidewall edges.

4. The pick holder of claim 2, wherein the lateral wall has a U-shape, the U-shape of the lateral wall and a material forming the lateral wall combining to provide flexibility to the holder body such that upon insertion of at least one of the first plurality of picks a restoring force is exerted on the first and second sidewalls to facilitate retention thereof.

5. The pick holder of claim 4, wherein the first sidewall includes a plurality of linear deformations that protrude into the first gap to facilitate securing the first plurality of picks therein.

6. The pick holder of claim 4, further comprising an elastomer layer disposed within the first gap and connected to at least one of the first and second sidewalls to facilitate securing the first plurality of picks therein.

7. The picks holder of claim 5, a faceplate disposed on the second sidewall and configured to define a second gap therebetween, the second gap being configured to hold a second pick that overlaps at least a portion of one of the first plurality of picks, the first and second sidewalls and the faceplate and the first plurality of picks and the second pick all being generally parallel planar, wherein any one of the first plurality of picks and the second pick can be withdrawn from the pick holder without moving the others.

8. The pick holder of claim 7, wherein the faceplate comprises an elongated portion configured to cover a portion of the second pick such that one corner of the second pick is overlapped while less than one half of each side of the second pick that forms the one corner is covered by the elongated section.

9. The pick holder of claim 8, wherein the faceplate is moveably attached to the second sidewall to allow all of the faceplate to move in a planar perpendicular direction relative to a major surface of the second sidewall.

10. The pick holder of claim 8, further comprising at least one prong extends from the elongated portion toward the second sidewall such that the at least one prong is configured to engage the second pick when the second pick is inserted into the second gap.

11. The pick holder of claim 10, further comprising two abutments positioned on second sidewall and configured to limit the insertion of the second pick, wherein the two abutments are configured to abut the each side which forms the corner of the second pick.

12. The pick holder of claim 11, wherein the elongated portion of the faceplate includes a second deformation that protrudes into the second gap to facilitate securing the second pick therein.

13. The pick holder of claim 12, wherein the faceplate is attached to the second sidewall by a single fastener.

14. The pick holder of claim 13, wherein a clip member extends from the holder body for detachably securing the pick holder to a guitar strap.

15. The pick holder of claim 14, wherein a single bore extends through the faceplate and through the first and second sidewalls to allow placement of the single fastener therethrough.

16. The pick holder of claim 15, wherein the single fastener has a hollow center to define a single channel which extends through the entire pick holder.

17. The pick holder of claim 15, wherein the only divider between the first plurality of picks that are in the first gap and any of a second plurality of picks that are overlappingly located in the second gap is the second sidewall, the first gap being free of any divider connecting the first and second sidewalls that is located between two of the first plurality of picks.

18. A pick holder comprising:

a holder body comprising first and second sidewalls, at least a portion of the first and second sidewalls are spaced apart and generally parallel planar so as to define a first gap therebetween, the first and second sidewalls being configured to allow a first pick to be detachably secured at least partially within the first gap, a faceplate disposed on the second sidewall and configured to define a second gap therebetween, the second gap being configured to hold a second pick that overlaps at least a portion of the first pick, the first and second sidewalls and the faceplate and the first and second picks all being generally parallel planar, wherein either one of the first and second picks can be withdrawn from the pick holder without moving the other of the first and second picks.

19. The pick holder of claim 18, further comprising:

the faceplate having an elongated portion configured to cover a portion of the second pick such that one corner of the second pick is overlapped while less than one half of each side of the second pick that forms the one corner is covered by the elongated section at least one prong extends from the elongated portion toward the second sidewall such that the at least one prong is configured to engage the second pick when the second pick is inserted into the second gap; and two abutments positioned on second sidewall and configured to limit the insertion of the second pick, wherein the two abutments are configured to abut the each side which forms the corner of the second pick.

20. A pick holder, comprising:

a holder body comprising first and second sidewalls, at least a portion of the first and second sidewalls are spaced apart and generally parallel planar so as to define a first gap therebetween, the first and second sidewalls being configured to allow each of a first plurality of picks to be detachably secured partially within the first gap along a common plane, the first and second sidewalls being configured such that at least some of the first plurality of picks can have a different angular orientation while secured in the holder body, the first and second sidewalls being further configured such that the first plurality of picks can be inserted into the pick holder using one of a first insertion path and a second insertion path, the first insertion path having a different orientation from the second insertion path; and a faceplate disposed on the second sidewall and configured to define a second gap therebetween, the second gap being configured to hold a second pick that overlaps at least a portion of one of the first plurality of picks, the first and second sidewalls and the faceplate and the first plurality of picks and the second pick all being generally parallel planar, wherein any one of the first plurality of picks and the second pick can be withdrawn from the pick holder without moving the others.

* * * * *